US007018755B2

(12) United States Patent
Ikegami et al.

(10) Patent No.: US 7,018,755 B2
(45) Date of Patent: Mar. 28, 2006

(54) ELECTROPHOTOGRAPHIC PHOTOCONDUCTOR, ELECTROPHOTOGRAPHY METHOD USING THE SAME, ELECTROPHOTOGRAPHIC APPARATUS, ELECTROGRAPHIC APPARATUS PROCESS CARTRIDGE AND ELECTROPHOTOGRAPHIC PHOTOCONDUCTOR OUTERMOST SURFACE LAYER COATING SOLUTION

(75) Inventors: Takaaki Ikegami, Shizuoka (JP); Tomoyuki Shimada, Shizuoka (JP); Yasuo Suzuki, Shizuoka (JP); Nozomu Tamoto, Shizuoka (JP); Hidetoshi Kami, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 58 days.

(21) Appl. No.: 10/667,410

(22) Filed: Sep. 23, 2003

(65) Prior Publication Data

US 2004/0126687 A1 Jul. 1, 2004

(30) Foreign Application Priority Data

Sep. 24, 2002 (JP) ..... 2002-276629

(51) Int. Cl.
*G03G 5/047* (2006.01)
*G03G 5/147* (2006.01)

(52) U.S. Cl. ..... 430/58.5; 430/58.75; 430/66; 430/73; 430/74; 430/76; 430/970; 430/126; 399/116; 399/159; 252/500

(58) Field of Classification Search ..... 430/58.5, 430/58.75, 66, 74, 76, 970, 73, 120, 126; 399/116, 159; 252/500
See application file for complete search history.

(56) References Cited

U.S. PATENT DOCUMENTS 3,730,712 A * 5/1973 Futaki ..... 430/72

FOREIGN PATENT DOCUMENTS

EP 1 205 808 5/2002

OTHER PUBLICATIONS

Grant, R. et. al., ed., *Grant's & Hackh's Chemical Dictionary*, fifth ediition, McGraw-Hill Book Company, NY (1987), p. 114.*

Patent Abstracts of Japan, JP 2002-207308, Jul. 26, 2002.
U.S. Appl. No. 10/792,607, filed Mar. 4, 2004, Ikegami et al.
U.S. Appl. No. 10/856,962, filed Jun. 1, 2004, Ikegami et al.
U.S. Appl. No. 11/006,643, filed Dec. 8, 2004, Takada et al.
U.S. Appl. No. 11/016,708, filed Dec. 21, 2004, Kitajima et al.
U.S. Appl. No. 11/030,307, filed Jan. 7, 2005, Kami et al.
U.S. Appl. No. 11/007,784, filed Dec. 9, 2004, Kondo et al.
U.S. Appl. No. 11/068,180 filed Mar. 1, 2005, Tamoto et al.

* cited by examiner

*Primary Examiner*—Janis L. Dote
(74) *Attorney, Agent, or Firm*—Oblon, Spivak, McClelland, Maier & Neustadt, P.C.

(57) ABSTRACT

An electrophotographic photoconductor having at least a photosensitive layer on a conductive support, wherein the electrophotographic photoconductor comprising, in the outermost layer thereof: a filler, an organic compound having an acid value of 10–400 mgKOH/g, and at least one of compounds represented by the following general formulas 1 and 2:

General Formula 1

General Formula 2 where $R^1$, $R^2$ are substituted or unsubstituted alkyl groups or aromatic hydrocarbon rings, and may be identical or different. $R^1$, $R^2$ may also be bonded together to form a substituted or unsubstituted heterocycle containing a nitrogen atom. $R^3$, $R^4$, $R^5$ are substituted or unsubstituted alkyl or alkoxy groups, or halogen atoms. Ar is a substituted or unsubstituted aromatic hydrocarbon ring or aromatic heterocycle. n is an integer in the range 2 to 4, and k, l, m are respectively integers in the range 0 to 3. X is an oxygen atom, or a sulfur atom.

25 Claims, 9 Drawing Sheets

ELECTROPHOTOGRAPHIC PHOTOCONDUCTOR, ELECTROPHOTOGRAPHY METHOD USING THE SAME, ELECTROPHOTOGRAPHIC APPARATUS, ELECTROGRAPHIC APPARATUS PROCESS CARTRIDGE AND ELECTROPHOTOGRAPHIC PHOTOCONDUCTOR OUTERMOST SURFACE LAYER COATING SOLUTION

BACKGROUND OF THE INVENTION

1. Field of the Invention

The present invention relates to an electrophotographic photoconductor which has high durability and realizes high definition. It further relates to an electrophotographic method using these photoconductors, an electrophotographic apparatus, and an electrophotographic process cartridge.

2. Description of the Related Art

In recent years, there has been a remarkable growth of information processing systems using electrophotography techniques. In particular, laser printers and digital copiers that change information into digital signals to record information by light have made remarkable improvements to print quality and reliability. In combination with high speed technology, they are now being applied to laser printers or digital copiers which can print in full color. As a result, it has now become important to obtain the dual objective of high definition and high durability as a function of required photoconductor.

In general, photoconductors used in electrophotographic laser printers and digital copiers employ organic photoconducting materials from the viewpoint of cost, productivity and non-pollution. Examples of organic photoconductors known in the art are photoconducting resins such as polyvinyl carbazole (PVK), charge transfer complex type such as PVK-TNF (2,4,7-trinitrofluoenone), pigment dispersion type such as phthalocyanine binders, and the discrete function type which combine a charge generating material with a charge transport material.

The mechanism of latent electrostatic-image formation in the discrete function type of photoconductor is as follows. The photoconductor is charged and irradiated with light, the light passes through a charge transport layer, and is absorbed by a charge generating material in the charge generating layer to generate a charge. The charge thus generated is implanted into the charge transport layer at the interface of the charge generating layer and charge transport layer, moves through the charge transport layer due to the electric field, and forms the latent electrostatic image by neutralizing the surface charge on the photoconductor.

However, when the organic photoconductor was used repeatedly, film scraping tended to occur, and if film scraping of the photoconducting layer was severe, the charging potential of the photoconductor decreased, photosensitivity deteriorated, the toner deposited due to scratches on the photoconductor surface, image density decreased or image quality seriously deteriorated, and the wear resistance of the photoconductor was consistently a major problem. In recent years, with higher speeds of electrophotography apparatus or smaller diameter photoconductors as devices become more compact, high durability of the photoconductor has become a much more important topic.

To achieve high durability of the photoconductor, a protective layer is usually provided on the outermost surface of the photoconductor, and this protective layer is given lubricant properties or hardened, or a filler is incorporated in the layer. The addition of a filler to the protective layer is a particularly effective way of improving the durability of the photoconductor. However, if the filler has strong electrical insulation properties, its resistance increases, and there is a considerable increase of residual potential. This residual potential rise is largely due to increase of resistance and an increase of charge trap sites which come about when the filler is incorporated. If a conductive filler is used, the resistance falls and the effect of residual potential increase is comparatively small, but then the image outline fades, image blurring occurs and there is a significant effect on image quality.

Therefore, in the related art, as it was difficult to use a filler with highly insulating properties, a filler with weaker insulating properties which had relatively little effect on residual potential was used, and a drum heater to heat the photoconductor was provided to deal with the image blurring produced. The heating of the photoconductor suppressed image blurring, however the provision of the drum heater necessitated an increase in the photoconductor diameter. This technique can therefore not be applied to the small diameter photoconductors which are now becoming common as electrophotographic equipment becomes more compact, and it is becoming difficult to achieve high durability with small diameter photoconductors. Also, if a drum heater is provided, the apparatus becomes more bulky and power consumption increases by a considerable extent, moreover a long time is required when starting up the apparatus, so many problems still remained to be solved.

If a filler with high electrical resistance is used, the increase of residual potential which is commonly observed leads to an increase of potential in the illuminated parts of the electrophotographic apparatus, which causes a decrease of image density and gradation. In order to compensate for this, it is necessary to increase the potential of the dark parts of the apparatus, but if the potential of the dark parts is increased, the electric field intensity increases, image defects such as toner background deposition occur, and the life of the photoconductor is also shortened.

As a means of suppressing residual potential rise in the related art, a method of using the protective layer as the photoconductive layer has been disclosed (Japanese Patent Application Publication (JP-B) No. 44-834, JP-B No. 43-16198, JP-B No. 49-10258). However, the light amount reaching the photoconductive layer decreased due to the absorption of light by the protective layer, there was a decrease in the sensitivity of the photoconductor, and its effect was only slight.

In another method, the average particle diameter of a metal or metal oxide contained as the filler is made equal to 0.3 μm or less (Japanese Patent Application Laid-Open (JP-A) No. 57-30846), so that the protective layer is effectively transparent, and accumulation of residual potential is suppressed. This method does have an effect in suppressing the increase of residual potential, but its effect is insufficient, and it still has not yet resolved the above problems. This is because the increase of residual potential when the filler is included, is probably due to charge traps or filler dispersibility if the filler is present, rather than to charge generating efficiency. Even if the average particle diameter of the filler is more than 0.3 μm, transparency can be obtained by increasing dispersibility, and even if the average particle diameter is less than 0.3 μm, the transparency of the film will decrease if the filler has a high degree of cohesion.

According to another method, a charge transport material is contained together with the filler in the protective layer (JP-A No. 04-281461), which increases the mechanical strength and suppresses residual potential rise. The addition of the charge transport material to the protective layer has the effect of improving the mobility of the charge, and is an effective way of reducing residual potential. However, if the considerable increase of residual potential resulting from the inclusion of the filler is due to increase of resistance and increase of trap sites when the filler is present, there will be a limit to the suppression of residual potential rise obtained by improving charge mobility. Therefore, the film thickness of the protective layer and the filler content must be decreased, and the necessary durability cannot be achieved.

There are other methods of suppressing residual potential rise, for example the addition of a Lewis acid to the protective layer (JP-A No. 53-133444), the addition of an organic protonic acid to the protective layer (JP-A No. 55-157748), the inclusion of an electron-accepting material (JP-A No. 02-4275), and the inclusion of a wax having an acid value of 5 (mg/KOH/g) or less (JP-A No. 2000-66434). These methods are thought to suppress the residual potential rise by improving the implantation of charge at the protective layer/electron transport layer interface, and making it easy for charge to reach the surface by forming a low resistance part in the protective layer. This method is found to have the effect of increasing residual potential, but it does tend to cause image blurring, and the superfluous effect on the image is obvious. Further, if an organic acid is added, it tends to decrease the filler dispersibility, so the effect is insufficient, and still could not resolve the present problems.

In an electrophotographic photoconductor which contains a filler to increase durability, in order to realize high image quality, it is important not only that image blurring or residual potential rise is suppressed, but also that charge reaches the photoconductor surface linearly without the filler in the protective layer interfering with charging. This is largely affected by filler dispersibility in the protective layer. If the filler agglomerates, and charge implanted from the charge transport layer to the protective layer moves to the surface, the progress of this charge tends to be obstructed by the filler, the dots formed by the toner become scattered, and resolution considerably decreases. Also, if a protective layer is provided, and the writing light is scattered by the filler so that the optical transmission decreases, there is likewise a marked unfavourable effect on resolution, and this effect on optical transmittance also has a close relationship with the filler dispersibility. The filler dispersibility also has a large impact on wear resistance. When the filler strongly agglomerates and dispersibility is poor, the wear resistance largely decreases. Therefore, in an electrophotographic photoconductor wherein a protective layer containing a filler is formed to improve durability, in order to simultaneously obtain high image quality, it is important not only to suppress image blurring and residual potential rise, but also to enhance the filler dispersibility in the protective layer.

However, an effective method of resolving all these problems had not yet been found, and if the outermost surface layer of the photoconductor were made to contain a filler to improve durability, image blurring or residual potential rise was very marked, and image quality problems had not yet been resolved. To mitigate these effects, it is necessary to install a drum heater, but high durability of small diameter photoconductors for which durability is most important had still not yet been achieved, and this was a major obstacle to achieving compactness and reducing power consumption.

SUMMARY OF THE INVENTION

It is therefore an object of the present invention, which was conceived in view of the above problems, to provide a photoconductor which has high durability, suppresses image deterioration due to residual potential rise or image blurring, and enables high-quality images to be obtained even after long periods of repeated use. It is a further object of the present invention to provide an electrophotographic method, electrophotographic apparatus and electrophotographic process cartridge which make use of such a photoconductor so that photoconductor replacement is unnecessary, high-speed printing and a compact apparatus can be realized using a small diameter photoconductor, and high image quality can be consistently obtained even after repeated use.

It is known that, in order to improve the durability of an electrophotographic photoconductor, it is effective to form a protective layer containing a filler on the outermost surface of the photoconductor, but this has the additional effect of residual potential rise or image blurring leading to image deterioration. The inventors, as a result of intensive studies, discovered that image blurring could be suppressed by incorporating a filler having highly insulating properties in the protective layer, and that residual potential rise could be suppressed by incorporating an organic compound having an acid value of 10 mgKOH/g to 400 mgKOH/g. One factor which enables reduction of residual potential is the addition of a material having an acid value, but another factor is the improvement of filler dispersibility resulting therefrom. Also, improving filler dispersibility has a number of different advantages. Specifically, it not only has the effect of suppressing residual potential rise, but as it prevents decrease of transmittance of the writing light in the protective layer and unevenness of image density, it also provides better image quality, improves wear resistance and prevents the appearance of film defects. However, due to the chemical structure of this organic compound, oxidizing gases such as ozone or NOx which may be produced during use are easily adsorbed, and in some cases can lower the resistance of the outermost surface layer or lead to problems such as image deletion. The inventors, by carrying out further studies, discovered that by incorporating at least one the compounds represented by the following general formulas 1 and 2:

General Formula 1

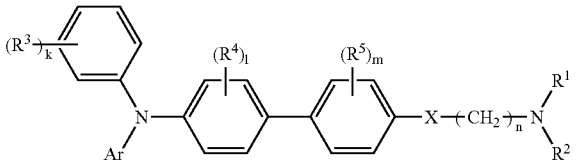

(In the general formula, $R^1$, $R^2$ are substituted or unsubstituted alkyl groups or aromatic hydrocarbon rings, and may be identical or different. $R^1$, $R^2$ may also be bonded together to form a substituted or unsubstituted heterocycle containing a nitrogen atom. $R^3$, $R^4$, $R^5$ are substituted or unsubstituted alkyl or alkoxy groups, or halogen atoms. Ar is a substituted or unsubstituted aromatic hydrocarbon ring or aromatic heterocycle. X is an oxygen atom, or a sulfur atom. n is an integer in the range 2 to 4, and k, l, m are respectively integers in the range 0 to 3.).

General Formula 2

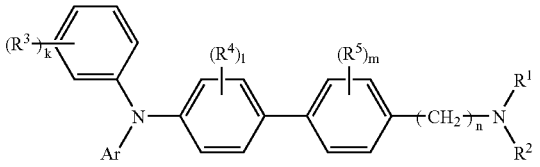

(In the general formula, $R^1$, $R^2$ are substituted or unsubstituted alkyl groups or aromatic hydrocarbon rings, and may be identical or different. $R^1$, $R^2$ may also be bonded together to form a substituted or unsubstituted heterocycle containing a nitrogen atom. $R^3$, $R^4$, $R^5$ are substituted or unsubstituted alkyl or alkoxy groups, or halogen atoms. Ar is a substituted or unsubstituted aromatic hydrocarbon ring or aromatic heterocycle. n is an integer in the range 2 to 4, and k, l, m are respectively integers in the range 0 to 3.)

the problems due to this oxidizing gas could be resolved.

Although the reason is not yet clear, it may be conjectured that the substituted amino group contained in the structure in addition to the benzene ring, which is a basic group, also contributes to suppressing the generation of radical moieties which is effective against oxidizing gases. Further, as the compounds represented by the general formulas 1 and 2 also have a charge transport ability, they do not function themselves as a charge carrier trap, so there is practically no deterioration of electrical characteristics such as residual potential rise due to their addition.

However, the precise reason is still unknown, including the reason for the very large difference in effect from Comparative Examples 1–5 described later.

However, in the compounds represented by the general formulas 1 and 2, as a result of further studies, it was discovered that due to their structure, a salt was produced by mutual interaction with the organic compound having an acid value of 10 mgKOH/g to 400 mgKOH/g which is included as another component ingredient in the present invention, and there was a problem regarding the time-dependent storage stability of the coating solution.

In view of this, the inventors, after further studies, discovered that the aforesaid time-dependent storage stability problems could be resolved by including a specific antioxidant in the coating solution.

By satisfying the following conditions, the inventors were able to provide an electrophotographic photoconductor which satisfied the dual objectives of high durability and high image quality, and which enabled high quality images to be consistently obtained even after repeated use, together with an electrophotographic method, electrophotographic apparatus and electrophotographic process cartridge which allowed high-quality images to be consistently obtained even after repeated use, and thereby arrived at the present invention.

The first aspect of the present invention is an electrophotographic photoconductor having at least a photosensitive layer on a conductive support, the electrophotographic photoconductor comprising, on the outermost surface layer of the electrophotographic photoconductor: a filler, an organic compound having an acid value of 10 mgKOH/g to 400 mgKOH/g, and at least one type of compound represented by the following general formulas 1 and 2:

General Formula 1

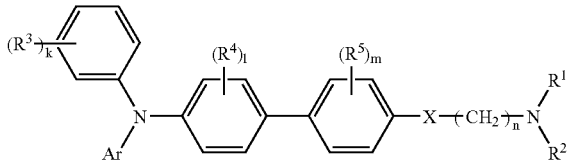

General Formula 2

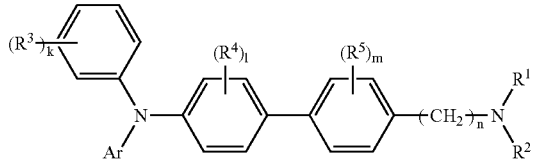

(In the general formulas 1 and 2, $R^1$, $R^2$ are substituted or unsubstituted alkyl groups or aromatic hydrocarbon rings, and may be identical or different. $R^1$, $R^2$ may also be bonded together to form a substituted or unsubstituted heterocycle containing a nitrogen atom. $R^3$, $R^4$, $R^5$ are substituted or unsubstituted alkyl or alkoxy groups, or halogen atoms. Ar is a substituted or unsubstituted aromatic hydrocarbon ring or aromatic heterocycle. n is an integer in the range 2 to 4, and k, l, m are respectively integers in the range 0 to 3. In the general formula 1, X is an oxygen atom, or a sulfur atom).

The second aspect of the present invention is an electrophotographic photoconductor outermost surface layer coating solution, comprising: a filler, an organic compound having an acid value of 10 mgKOH/g to 400 mgKOH/g, and at least one type of compound represented by the above general formulas 1 and 2, and an antioxidant.

The third aspect of the present invention is an electrophotographic method, comprising: a charging step for charging an electrophotographic photoconductor, an exposure step for forming an latent electrostatic image by exposing an image on the photoconductor charged by the charging step, a developing step for forming a toner image by supplying a developer to the latent electrostatic image to render the latent electrostatic image visible, and a transfer step for transferring the toner image formed by the developing step to a transfer material,: the electrophotographic photoconductor comprising: a filler, an organic compound having an acid value of 10 mgKOH/g to 400 mgKOH/g, and at least one type of compound represented by the above general formulas 1 and 2, in the outermost surface layer thereof.

The fourth aspect of the present invention is an electrophotographic apparatus, comprising: an electrophotographic photoconductor, a charger for charging the electrophotographic photoconductor, an exposure unit for forming an latent electrostatic image by exposing an image on the photoconductor charged by the charger, a developing unit for forming a toner image by supplying a developer to the latent electrostatic image to render the latent electrostatic image visible, and a transfer unit for transferring the toner image formed by the developing unit to a transfer material, the electrophotographic photoconductor containing: a filler, an organic compound having an acid value of 10 mgKOH/g to 400 mgKOH/g, and at least one type of compound represented by the above general formulas 1 and 2, in the outermost surface layer thereof.

The fifth aspect of the present invention is an electrophotographic process cartridge, wherein at least one of a charger for uniformly charging the surface of an electrophotographic photoconductor, a cleaning unit for cleaning the surface of the electrophotographic photoconductor and a developing unit for forming a toner image by supplying a developer to the latent electrostatic image on the electrophotographic photoconductor to render the latent electrostatic image visible, is formed together with the electrophotographic photoconductor in a one-piece construction such that it can be freely attached to or removed from the electrophotographic photoconductor body, and wherein the electrophotographic photoconductor contains: a filler, an organic compound having an acid value of 10 mgKOH/g to 400 mgKOH/g, and at least one type of compound represented by the above general formulas 1 and 2, in the outermost surface layer thereof.

Highly durable electrophotographic photoconductors containing a filler in the protective layer of the electrophotographic photoconductor, inevitably are associated with adverse effects such as image blurring, residual potential rise and decrease of resolution, and it was difficult to achieve the dual objects of high durability and high definition. This is because high resistance is suitable for suppressing image blurring whereas low resistance is suitable for suppressing residual potential rise, and the fact that there was a trade-off between these two factors made it difficult to resolve the problem.

However, the studies carried out by the inventors showed that it was not only the physical properties of the filler which had an effect on the residual potential and the image quality, and that the filler dispersibility made a large contribution. In other words, when the filler does not stick together and dispersibility is good, the charge which is implanted to the protective layer easily reaches the surface, so not only can residual potential rise be suppressed, but also the reproducibility of dots formed by the toner is more reliable and a high-resolution image can be obtained. On the other hand, when the filler is largely agglomerated, the progress of the charge is obstructed by the filler, so that not only does the resolution decrease due to the decrease in linearity of charge movement, but also the charge is easily trapped and leads to an increase of residual potential.

Agglomeration of the filler tends to occur with inorganic (hydrophilic) fillers having a low affinity for organic solvents or binder resins. The affinity between the inorganic filler and organic solvent or binder resin can be enhanced by adding the organic compound having an acid value of 10 mgKOH/g to 400 mgKOH/g discovered in the present invention, which has the effect of enhancing filler dispersibility. It also has the effect of reducing the film resistance, which has increased too much due to the addition of acid, to a suitable level. Due to this synergistic effect, not only is the residual potential of the photoconductor decreased, but due to the improvement in filler dispersibility, the scatter of dots formed by the toner is reduced, and a high-quality image with more faithful dot reproduction can be obtained.

The improvement of filler dispersibility has very many advantages regarding improvement of image quality, such as improved light transmittance in the outermost surface layer and suppression of image density unevenness, while it also improves wear resistance and suppresses film defects. In addition, a protective layer-forming coating solution with high stability and long life can be obtained, and as a result, an electrophotographic photoconductor which achieves the dual objectives of high durability and high image quality can be consistently obtained over a long period.

DESCRIPTION OF THE PREFERRED EMBODIMENTS

Figure 1:
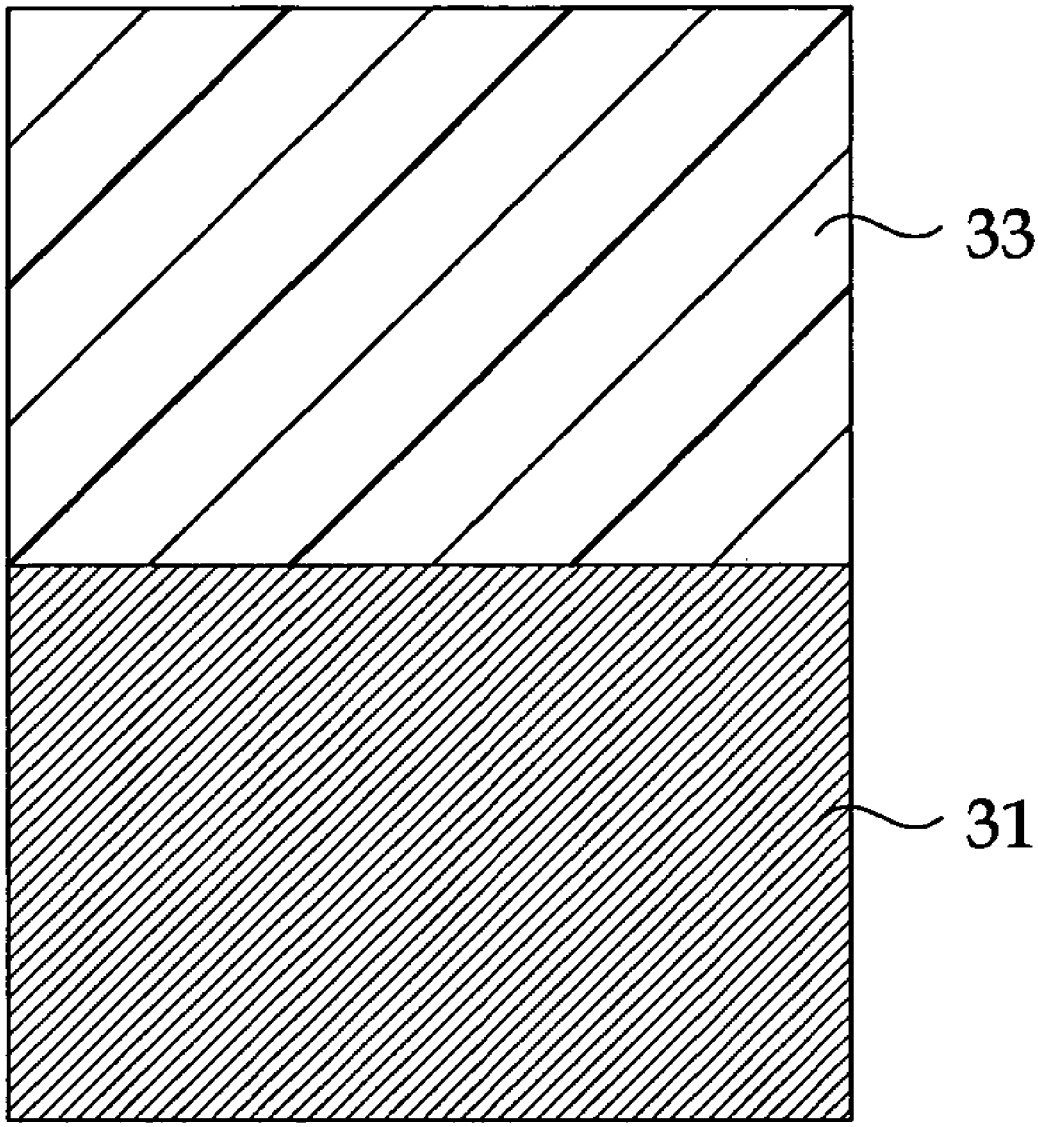
FIG. 1 is a diagram showing an example of the lamination of an electrophotographic photoconductor used in the present invention.

Hereafter, the electrophotographic photoconductor used in the present invention will be described referring to the drawings.

FIG. 1 is a sectional view showing the electrophotography photoconductor of the present invention. A photosensitive layer (33) having a charge generating material and a charge transport material as main components is provided on a conductive support (31). At least a filler is contained in the photoconductive layer surface.

Figure 2:
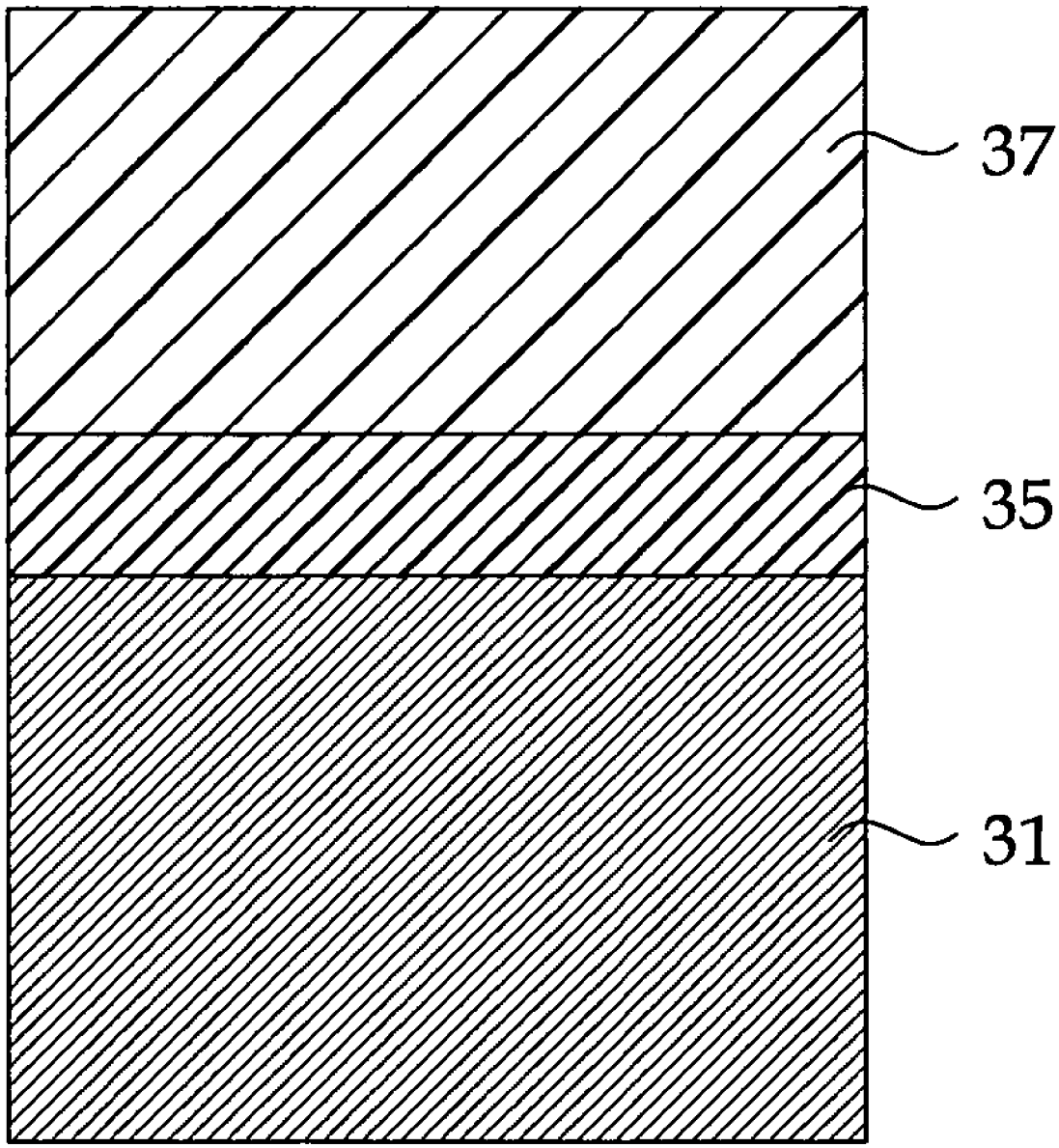
FIG. 2 is a diagram showing an example of the lamination of another electrophotographic photoconductor used in the present invention.

FIG. 2 shows a charge generating layer (35) having a charge generating material as main component and charge transport layer (37) having a charge transport material as main component, laminated on the conductive support (31). At least a filler is contained in the surface of the charge transport layer.

Figure 3:
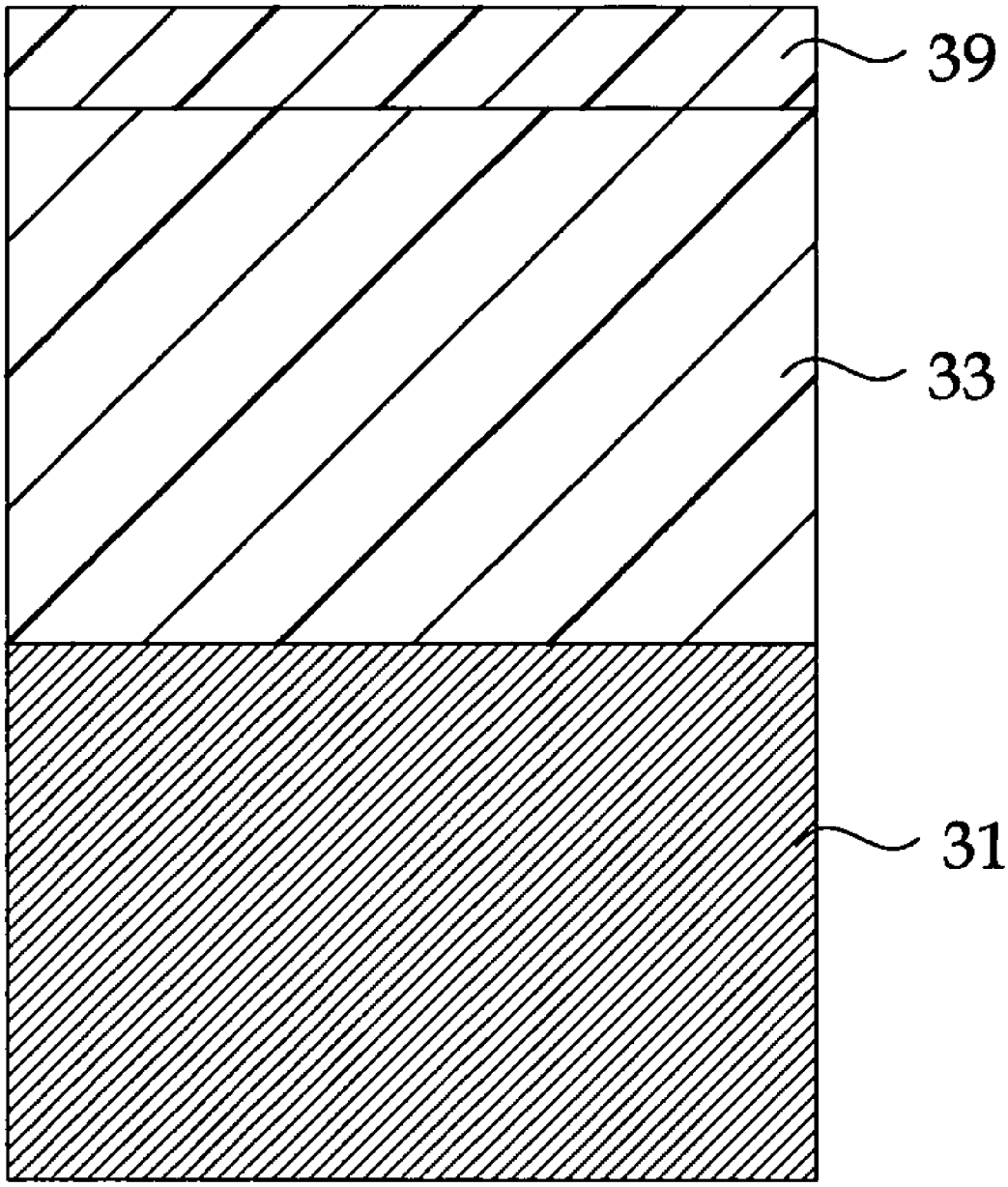
FIG. 3 is a diagram showing an example of the lamination of another electrophotographic photoconductor used in the present invention.

FIG. 3 shows the photosensitive layer (33) having a charge generating material and charge transport material on the conductive support (31), and a protective layer (39) on the photosensitive layer surface. In this case, the protective layer (39) contains the filler.

Figure 4:
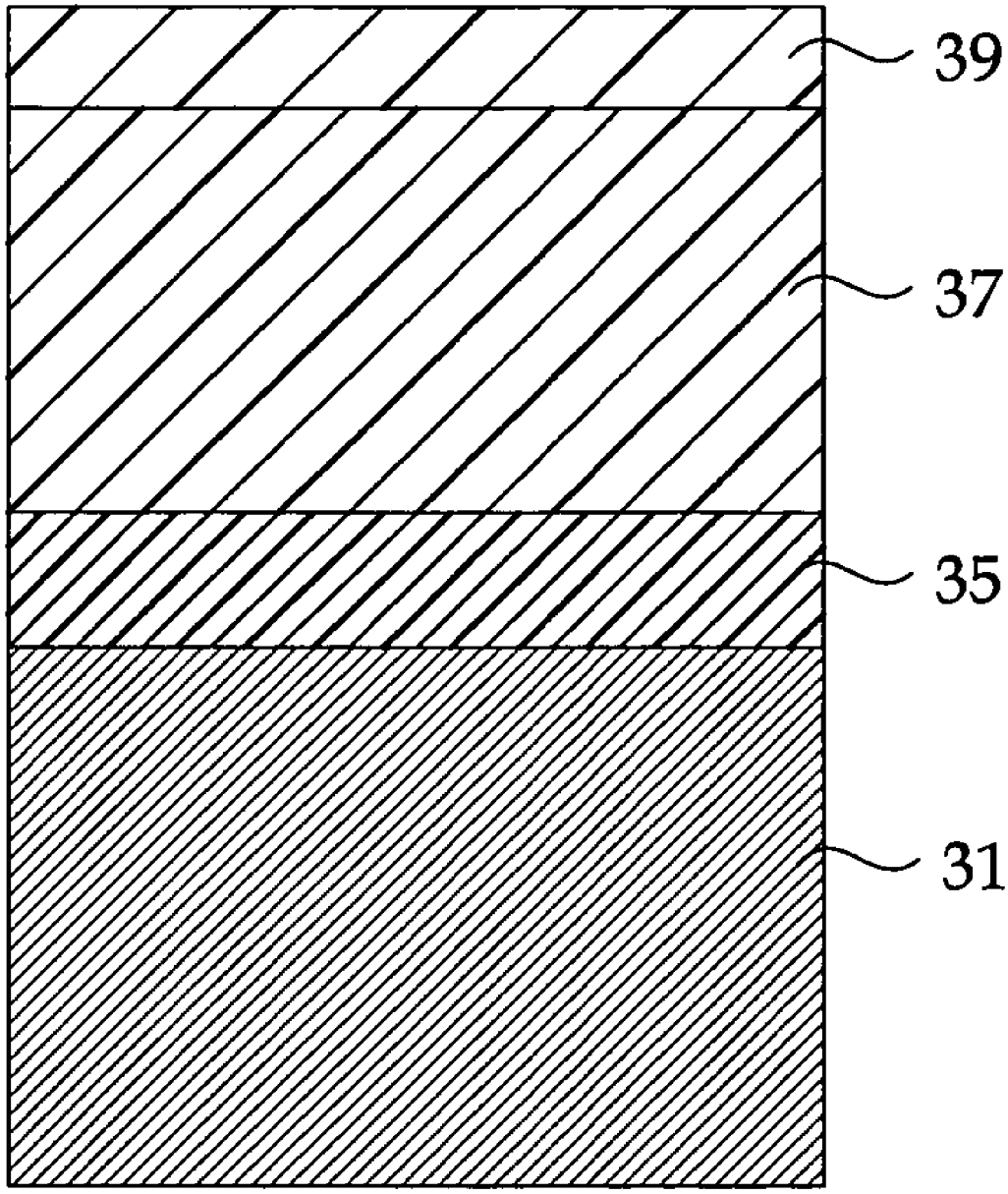
FIG. 4 is a diagram showing an example of the lamination of another electrophotographic photoconductor used in the present invention.

FIG. 4 shows a construction wherein the charge generating layer (35) having a charge generating material as main component and charge transport layer (37) having a charge transport material as main component, are laminated on the conductive support (31), and the protective layer (39) is further provided on the charge transport layer. In this case, the protective layer (39) contains the filler.

Figure 5:
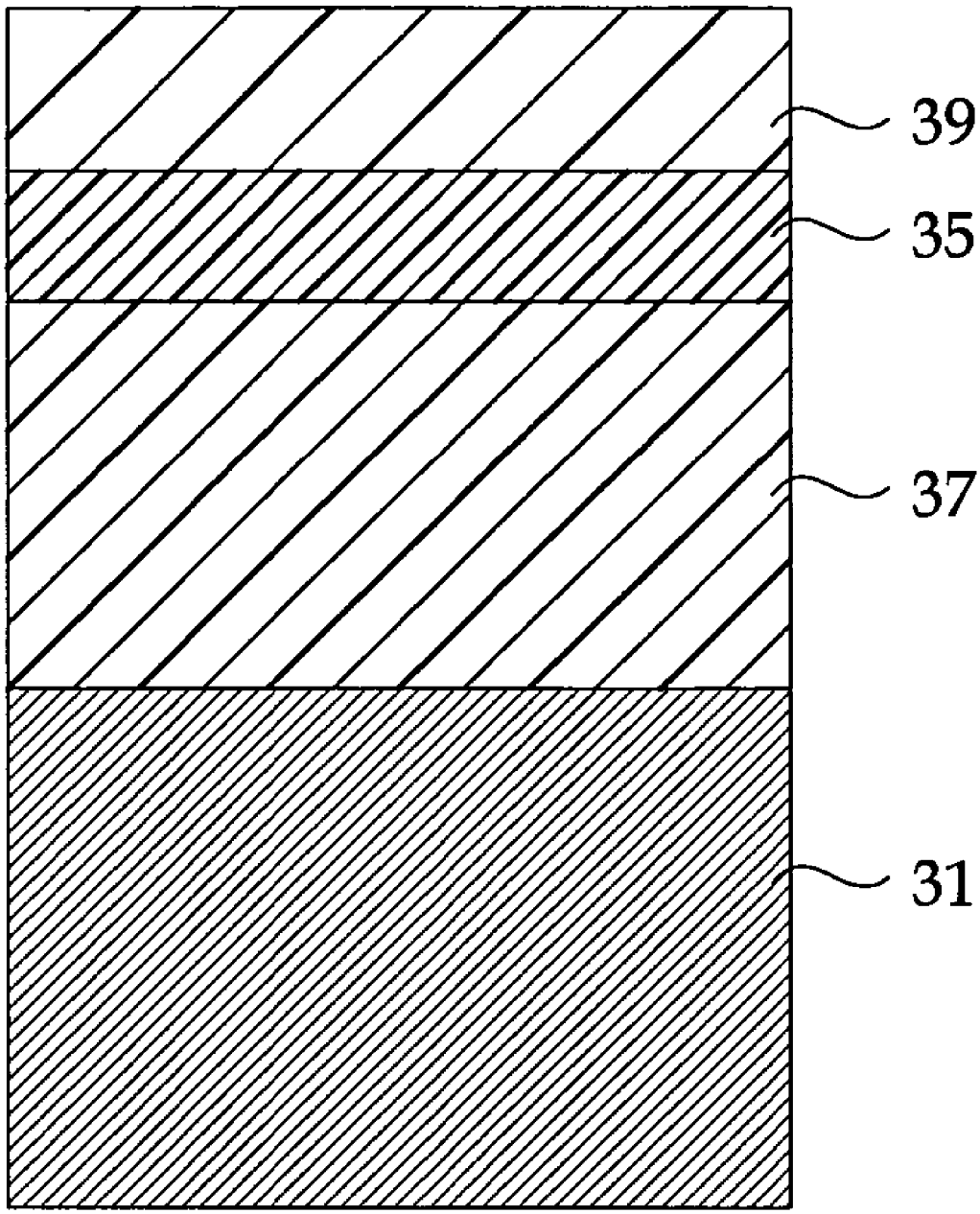
FIG. 5 is a diagram showing an example of the lamination of another electrophotographic photoconductor used in the present invention.

FIG. 5 shows a construction wherein the charge transport layer (37) having a charge transport material as main component and charge generating layer (35) having a charge generating material as main component, are laminated on the conductive support (31), and the protective layer (39) is further provided on the charge generating layer. In this case, the protective layer (39) contains the filler.

The conductive support (31) may be a film-shaped or cylindrically-shaped plastic or paper covered with a conducting material having a volume resistivity of $10^{10}\Omega\cdot$cm, e.g., a metal such as aluminum, nickel, chromium, nichrome, copper, gold, silver or platinum, or a metal oxide such as tin oxide or indium oxide, by vapor deposition or sputtering, or it may be a plate of aluminum, aluminum alloy, nickel or stainless steel, and this may be formed into a tube by extrusion or drawing, cut, polished and surface-treated. The endless nickel belt and endless stainless steel belt disclosed in JP-A 52-36016 can also be used as the conductive support (31).

In addition, a conductive powder may also be dispersed in the binder resin and coated on the support, and used as the conductive support (31) of the present invention. Examples of this conductive powder are carbon black, acetylene black, metal powders such as aluminum, nickel, iron, nichrome, copper, zinc and silver, and a metal oxide such as conductive tin oxide and ITO or the like. The binder resin used together may also comprise a thermoplastic resin, thermosetting resin or photosetting resin such as polystyrene, styrene-acrylonitrile copolymer, styrene-butadiene copolymer, styrene-maleic anhydride copolymer, polyester, polyvinyl chloride, vinyl chloride, vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin or alkyd resin. Such a conductive layer can be provided by dispersing and applying these conductive powders and binder resin in a suitable solvent, for example, tetrahydrofuran, dichloromethane, methyl ethyl ketone or toluene.

A construction apparatus wherein a conductive layer is provided on a suitable cylindrical substrate by a heat-shrinkable tubing containing these conductive powders in a material such as polyvinyl chloride, polypropylene, polyester, polystyrene, polyvinylidene chloride, polyethylene, chlorinated rubber or polytetrafluoroethylene fluoro-resin, can also be used as the conductive support (31) of the present invention.

Next the photosensitive layer will be described. The photosensitive layer may be a single layer or a laminate, but for convenience, the case will be described where it comprises the charge generating layer (35) and charge transport layer (37).

The charge generating layer (35) is a layer which comprises mainly a charge generating material. The charge generating layer (35) may be a charge generating material known in the art, examples being monoazo pigments, diazo pigments, triazo pigments, perylene pigments, perinone pigments, quinacridone pigmets, quinone condensation polycyclic compounds, squalic acid dyes, other phthalocyanine pigments, naphthalocyanine pigments and azulenium salt dyes, etc. These charge generating materials may be used alone, or two or more may be used in admixture.

The charge generating layer (35) is formed by dispersing the charge generating material together with the binder resin if necessary in a suitable solvent using a ball mill, attritor or sand mill, or by ultrasonic waves, coating this on the conductive support, and drying.

Examples of the binder resin which is used in the charge generating layer (35) if required, are polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylamide, polyvinyl benzal, polyester, phenoxy resin, vinyl chloride-vinyl acetate copolymer, poly vinyl acetate, polyphenylene oxide, polyamide, polyvinyl pyridine, cellulose resin, casein, polyvinyl alcohol and polyvinyl pyrrolidone. The amount of binder resin is 0 part by weight to 500 parts by weight, and preferably 10 parts by weight to 300 parts by weight, relative to 100 parts by weight of the charge generating material. The binder resin may be added before or after dispersion.

The solvent used herein may be isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene or ligroin, and ketone solvents, ester solvents and ether solvents are particularly preferred. These solvents may be used alone, or two or more may be used in admixture.

The charge generating layer (35) comprises the charge generating material, solvent and binder resin as main components, but it may also contain any other additives such as an intensifier, a dispersant, a surfactant or silicone oil.

The coating solution may be applied by impregnation coating, spray coating, beat coating, nozzle coating, spinner coating or ring coating.

The film thickness of the charge generating layer (35) is 0.01 μm to 5 μm, and preferably 0.1 μm to 2 μm.

The charge transport layer (37) is formed by dissolving the charge transport material and binder resin in a suitable solvent, applying this to the charge generating layer, and drying. If required, one, two or more of a plasticizer, levelling agent and antioxidant can also be added.

The charge transport material may be a positive hole transport material or electron transport material.

Examples of the electron transport material are electron acceptors such as chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and benzoquinone derivatives.

Examples of positive hole transport substances are poly-N-vinylcarbazole and its derivatives, poly-γ-carbazole ethyl glutamate and its derivatives, pyrene-formaldehyde condensate and its derivatives, polyvinyl pyrene, polyvinyl phenanthrene and polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triaryl methane derivatives, 9-stylanthracene derivatives, pyrazoline derivatives, divinylbenzene derivatives, hydrazone derivatives, indene derivatives, butadiene derivatives and pyrene derivatives, bisstilbene derivatives, enamine derivatives, and other known materials may be used. These charge transport materials may be used alone, or two or more be mixed and used together.

Examples of the binder resin are thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin and alkyd resin.

The amount of charge transport material is 20 parts by weight to 300 parts by weight, and preferably 40 parts by weight to 150 parts by weight with respect to 100 parts by weight of the binder resin. From the viewpoint of resolution and response, the thickness of the charge transport layer is preferably 25 μm or less. The lower limit will differ depending on the system (in particular, charging potential, etc.) used, and 5 μm or more is preferred.

Examples of the solvent used herein are tetrahydrofuran, dioxane, toluene, dichloromethane, monochlorobenzene, dichloroethane, cyclohexanone, methyl ethyl ketone and acetone. These may be used alone, or two or more kinds may be used together.

When the charge transport layer is the outermost surface layer of the photoconductor, a filler material can also be added at least to the surface part of the charge transport layer to improve wear resistance. Examples of organic filler materials are fluororesin powders such as polytetrafluoroethylene, silicone resin powder, and a-carbon powder, and examples of inorganic filler materials are metal powders such as copper, tin, aluminum and indium, metal oxides such as silica, tin oxide, zinc oxide, titanium oxide, alumina, zirconium dioxide, indium oxide, antimony oxide, bismuth oxide, calcium oxide and tin oxide doped with antimony, metal fluorides such as tin fluoride, calcium fluoride and aluminum fluoride, potassium titanate and boron nitride. In these fillers, from the viewpoint of hardness of the filler, it is advantageous to use inorganic materials to improve wear resistance.

As fillers which do not easily lead to image blurring, a filler with highly insulating properties is preferred, in particular a filler having a pH of 5 or more, or a dielectric constant of 5 or more is effective, specific examples being titanium oxide, alumina, zinc oxide and zirconium dioxide. A filler having a pH of 5 or a dielectric constant of 5 or more can of course be used alone, but fillers having a pH of less than 5 may be combined with fillers having a pH of 5 or more, and fillers having a dielectric constant of less than 5 may be combined with fillers having a dielectric constant of 5 or more. Also, of these fillers, α-alumina has highly insulating properties, high thermal stability and a hexagonal close-packed structure which has high wear resistance, so it is particularly useful from the viewpoint of suppressing image blurring and improving wear resistance.

These fillers may be surface-treated with at least one type of surface treatment agent, and this is preferred from the viewpoint of filler dispersibility. If the filler dispersibility decreases, it not only leads to increase of residual potential, but also to reduction of film transparency and film defects, as well as decrease of wear resistance, and this may become a major obstacle to achieving high durability or high image quality. The surface treatment agents may be any of the surface treatment agents used in the art, but surface treatment agents which can maintain filler insulating properties are preferred. Examples are titanate coupling agents, aluminum coupling agents, zircoaluminate coupling agents, higher fatty acids or mixtures thereof with a silane coupling agent, and $Al_2O_3$, $TiO_2$, $ZrO_2$, silicone and aluminum stearate, or mixtures thereof, which are preferred from the viewpoints of filler dispersibility and suppression of image blurring. Treatment with a silane coupling agent has an effect enhancing image blurring, but this effect may be suppressed by treatment with a mixture of the aforesaid surface treatment agent and a silane coupling agent. The surface treatment differs according to the average first-order particle diameter of the filler used, but is 3% by weigh to 30% by weight and more preferably 5% by weight to 20% by weight. If the surface treatment amount is less than this, the filler dispersibility effect is not obtained, and if it is too much, it causes a considerable rise of residual potential.

If these fillers are included, high durability can be realized and image blurring can be avoided, but the effect of residual potential rise increases. To suppress the residual potential rise, an organic compound having an acid value of 10 mgKOH/g to 400 mgKOH/g may be added. The acid value is defined as the number of milligrams of potassium hydroxide required to neutralize free fatty acids contained in 1 g. This organic compound having an acid value of 10 mgKOH/g to 400 mgKOH/g may be any of the organic compounds having an acid value of 10 mgKOH/g to 400 mgKOH/g such as organic fatty acids or high acid value resins which are generally known in the art. However, as organic acids or acceptors having an extremely low molecular weight may lead to a large decrease of filler dispersibility, it may occur that the residual potential reduction effect is not fully manifested. Therefore, to reduce the residual potential of the photoconductor and enhance filler dispersibility, the use of low molecular weight polymers or resins, copolymers and mixtures thereof is preferred. The structure of these organic compounds is more preferably a linear structure which does not offer much steric hindrance. To improve dispersibility, organic compound having an acid value of 10 mgKOH/g to 400 mgKOH/g must have affinity with both the filler and binder resin, and materials having a large steric hindrance cause a decrease of this affinity, thereby decreasing dispersibility and leading to many problems as noted above. Polycarboxylic acid is a compound having a structure containing carboxylic acid in a polymer or copolymer. It may be an organic compound containing carboxylic acid such as a copolymer using polyester resin, acrylate resin, acrylic acid or methacrylic acid, or a styrene-acrylic copolymer, or any derivative thereof. Further, two or more of these materials may be used together, which is effective. In some cases, if these materials are combined with an organic fatty acid, filler dispersibility or the concomitant decrease of residual potential may be enhanced.

The addition amount of organic compound containing 10 mgKOH/g to 400 mgKOH/g is 0.01% by weight to 50% by weight, and preferably 0.1% by weight to 20% by weight relative to the filler, but it is more preferred to set it to the minimum required amount. If the addition amount is larger than necessary, image blurring may appear, and if the addition amount is too small, the residual potential decrease effect is not fully manifested. The acid value of the organic compound is preferably 10 mgKOH/g to 400 mgKOH/g, and more preferably 30 mgKOH/g to 200 mgKOH/g. If the acid value is higher than necessary, the resistance drops too low and the image blurring effect increases, while if the acid value is too low, the addition amount must be increased and the residual potential decrease effect is insufficient. The acid value of the material must also be determined in consideration of the balance with addition amount. However, the acid value of the material does not directly affect the residual potential decrease effect, and is largely influenced by the structure or molecular weight of the organic compound used and the filler dispersibility.

These organic compounds having an acid value of 10 mgKOH/g to 400 mgKOH/g may be added in order to decrease residual potential even when the charge transport layer does not contain a filler. The addition amount depends upon the acid value of the material which is added, but it is 0.01% by weight to 50% by weight, and preferably 0.1% by weight to 20% by weight relative to binder resin. Due to addition of polycarbonic acid, not only does the residual potential decrease, but filming may also be suppressed and adhesion properties of the film enhanced, so it is effective and useful. However, if more than necessary is added, image blurring may occur and wear resistance may decrease.

The filler material may be dispersed together with at least a solvent and the organic compound having an acid value of 10 mgKOH/g to 400 mgKOH/g using a prior part technique such as a ball mill, attritor, sand mill or ultrasonic waves. Of these, dispersion by ball mill is more preferred from the viewpoint of dispersibility as it permits higher contact efficiency between the filler and the organic compound having an acid value of 10 mgKOH/g to 400 mgKOH/g, and introduction of impurities from outside is less. The media used may be any of the media used in the art such as zirconia, alumina or agate, but from the viewpoint of filler dispersibility and residual potential decrease effect, alumina is more preferred. If zirconia is used, the wear amount of the media during dispersion is large, and residual potential considerably increases when these are added. Further, dispersibility considerably decreases due to the addition of this abrasion powder, and filler sedimentation is promoted. On the other hand, if alumina is used as the media, although the media does suffer wear during dispersion, the wear amount is suppressed low, and the abrasion powder which is added has an extremely small effect on residual potential. Moreover, the adverse effect on dispersibility is small even if an abrasion powder is added. Therefore, the use of alumina as the media used for dispersion is more preferred.

By adding the organic compound having an acid value of 10 mgKOH/g to 400 mgKOH/g together with the filler and organic solvent, filler cohesion in the coating solution and filler sedimentation are suppressed, and filler dispersibility is remarkably improved, so it is preferred to add it prior to dispersion. The binder resin and charge transport material may also be added prior to dispersion, but in this case, the dispersibility may slightly decrease. Therefore, the binder resin and charge transport material are preferably added dissolved in the organic solvent after dispersion.

From the viewpoint of the optical transmittance and wear resistance properties of the protective layer, the average first-order particle diameter of the filler is preferably 0.01 μm to 0.5 μm. If the average first-order particle diameter of the filler is less than 0.01 μm, wear resistance properties decrease and dispersibility decreases, whereas if it is more than 0.5 μm, filler sedimentation may be promoted and toner filming may occur.

However, in this organic compound, due to its chemical structure, oxidizing gases such as ozone or $NO_x$ which were produced according to the conditions, tended to be adsorbed, and in some cases this led to problems such as low resistance of the outermost surface and image deletion. These problems were resolved by adding the compound represented by the following general formulas 1 and 2:

General Formula 1

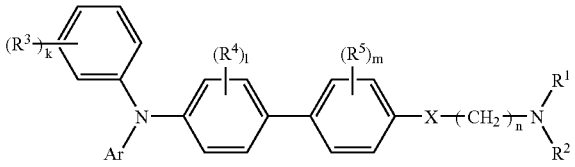

(In the general formula, $R^1$, $R^2$ are substituted or unsubstituted alkyl groups or aromatic hydrocarbon rings, and may be identical or different. $R^1$, $R^2$ may also be bonded together to form a substituted or unsubstituted heterocycle containing a nitrogen atom. $R^3$, $R^4$, $R^5$ are substituted or unsubstituted alkyl or alkoxy groups, or halogen atoms. Ar is a substituted or unsubstituted aromatic hydrocarbon ring or aromatic heterocycle. X is an oxygen atom, or a sulfur atom. n is an integer in the range 2 to 4, and k, l, m are respectively integers in the range 0 to 3.).

General Formula 2

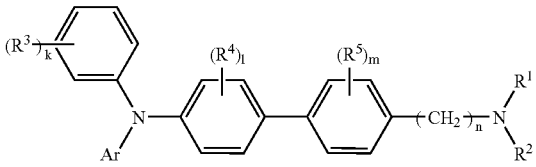

(In the general formula, $R^1$, $R^2$ are substituted or unsubstituted alkyl groups or aromatic hydrocarbon rings, and may be identical or different. $R^1$, $R^2$ may also be bonded together to form a substituted or unsubstituted heterocycle containing a nitrogen atom. $R^3$, $R^4$, $R^5$ are substituted or unsubstituted alkyl or alkoxy groups, or halogen atoms. Ar is a substituted or unsubstituted aromatic hydrocarbon ring or aromatic heterocycle. n is an integer in the range 2 to 4, and k, l, m are respectively integers in the range 0 to 3.).

Examples of the alkyl group in the general formula are methyl, ethyl, propyl, butyl, hexyl and undecyl. Examples of cyclic aromatic groups are monovalent-hexavalent aromatic hydrocarbon groups having an aromatic hydrocarbon ring, such as benzene, naphthalene, anthracene and pyrene, and monovalent-hexavalent heterocyclic groups having a heterocyclic aromatic ring such as pyridine, quinoline, thiophene, furan, oxazole, oxadiazole and carbazole. Examples of substituents thereof are the alkyl groups given in the aforesaid examples, alkoxy groups such as methoxy, ethoxy, propoxy and butoxy, halogen atoms such as fluorine, chlorine, bromine and iodine, and aromatic rings. Examples of heterocyclic groups wherein $R^1$ and $R^2$ are bonded together comprising a nitrogen atom, are pyrrolidinyl, piperidinyl and pyrolinyl. Other examples of heterocyclic groups all comprising a nitrogen atom are aromatic heterocyclic groups such as N-methyl carbazole, N-ethyl carbazole, N-phenyl carbazole, indole, and quinoline.

Preferred examples of the general formulas 1 and 2 are given below, however, the present invention is not limited to these compounds.

TABLE 1
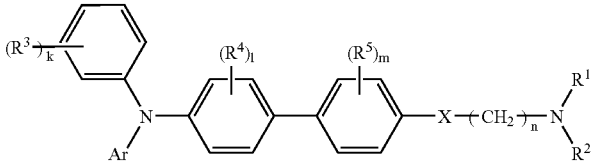
| Compound No. | Structural Formula |
|---|---|
| 1-1 | 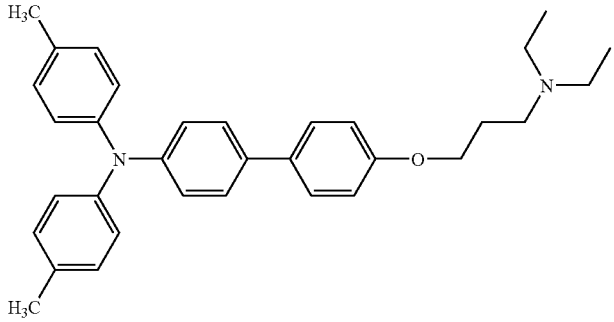 |
| 1-2 | 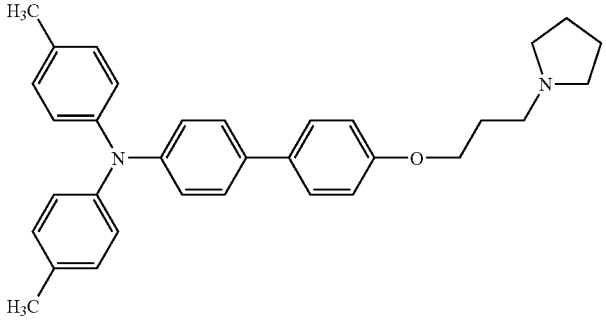 |
| 1-3 | 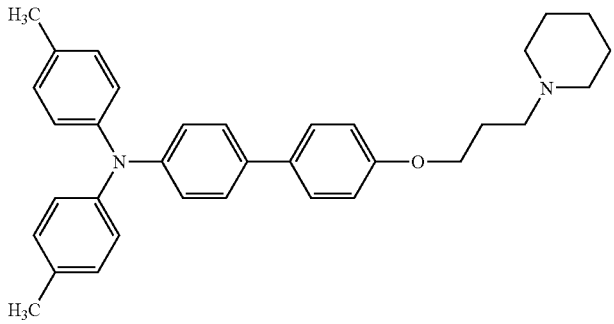 |
| 1-4 | 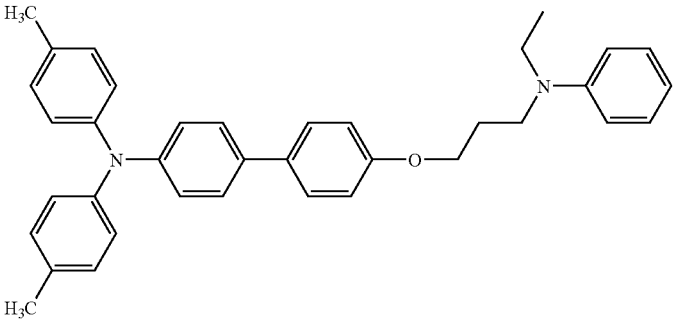 |

TABLE 1-continued
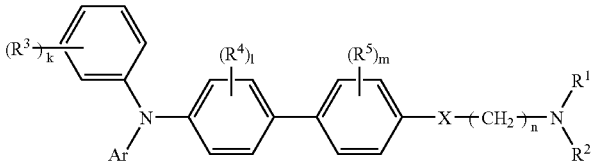
| Compound No. | Structural Formula |
|---|---|
| 1-5 | 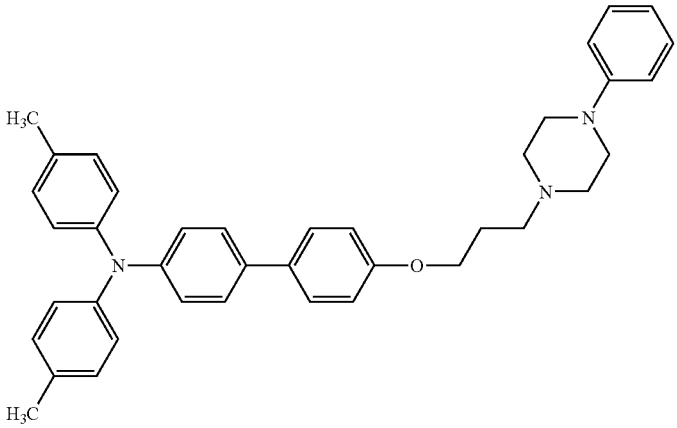 |
| 1-6 | 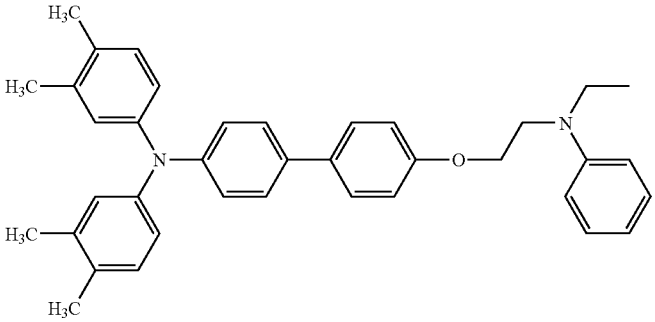 |
| 1-7 | 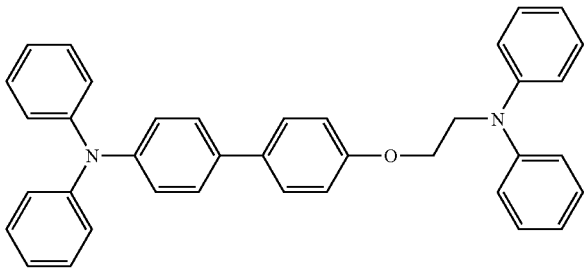 |
| 1-8 | 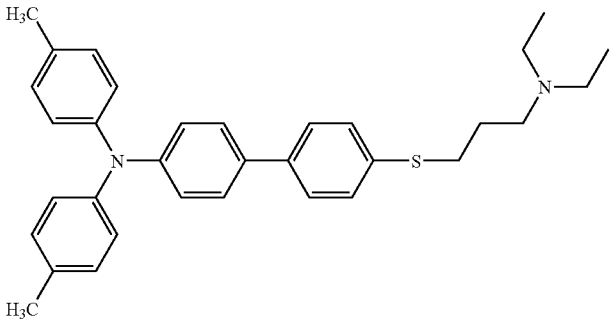 |

TABLE 1-continued
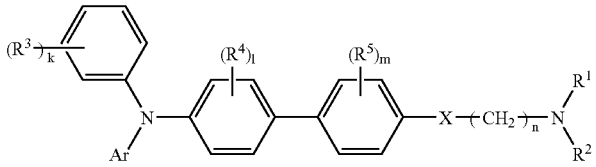
| Compound No. | Structural Formula |
|---|---|
| 1-9 | 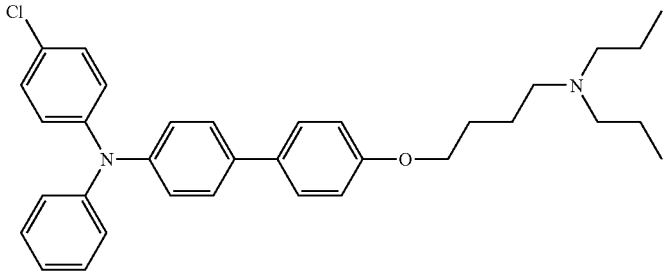 |
| 1-10 | 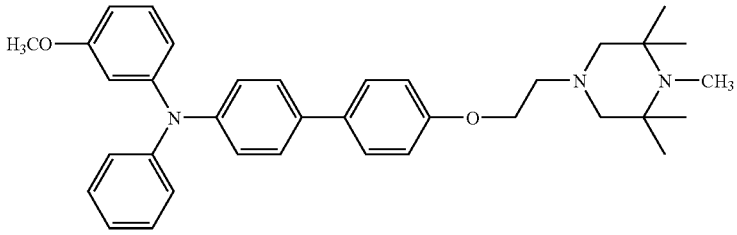 |
| 1-11 | 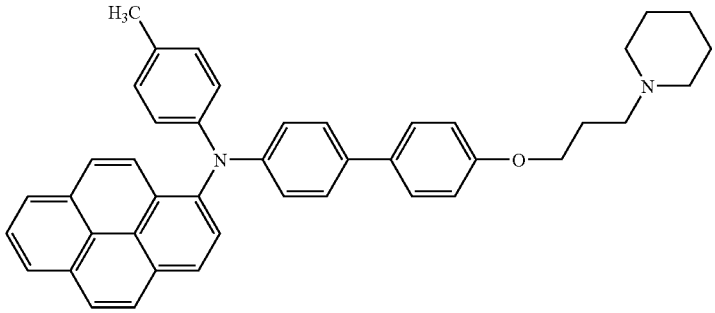 |
| 1-12 | 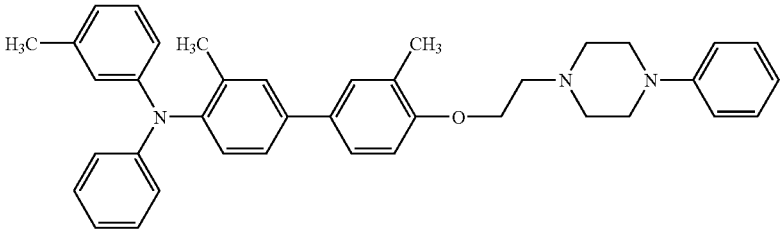 |
| 1-13 | 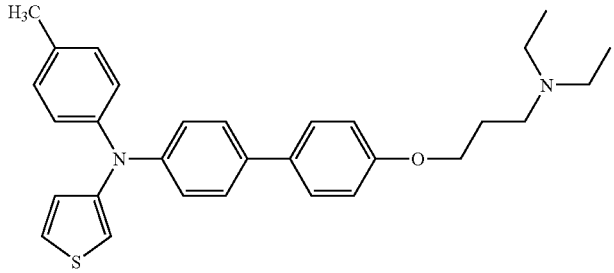 |

TABLE 2
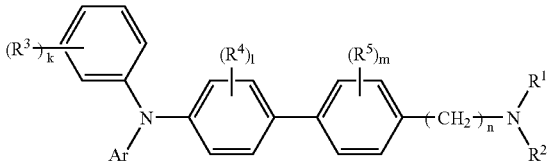
| Compound No. | Structural Formula |
|---|---|
| 2-1 | 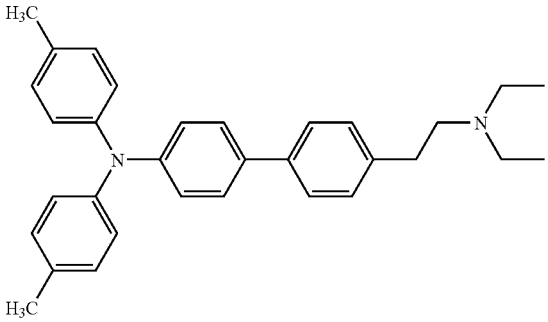 |
| 2-2 | 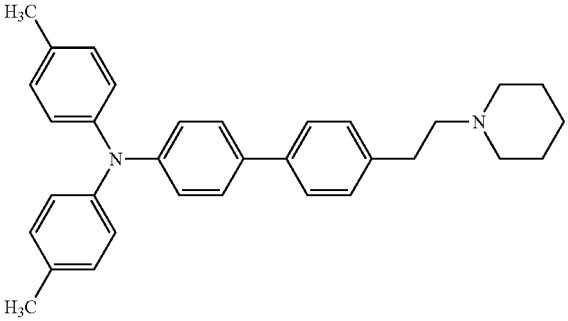 |
| 2-3 | 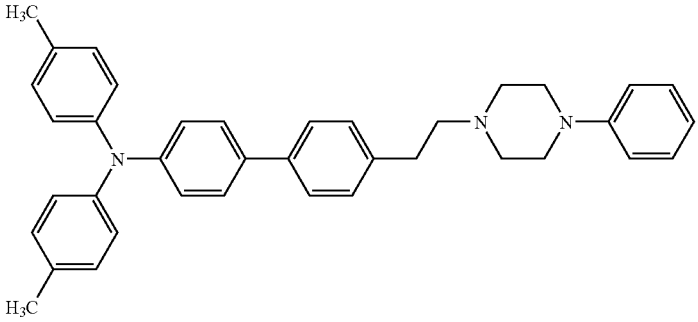 |
| 2-4 | 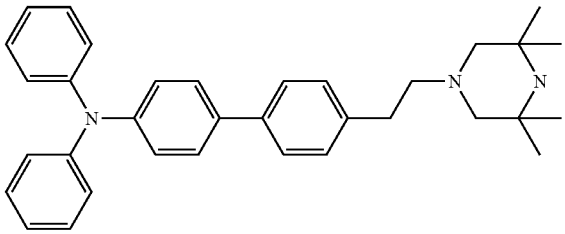 |

TABLE 2-continued
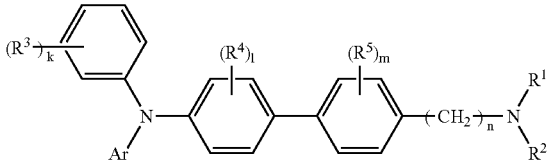
| Compound No. | Structural Formula |
|---|---|
| 2-5 | 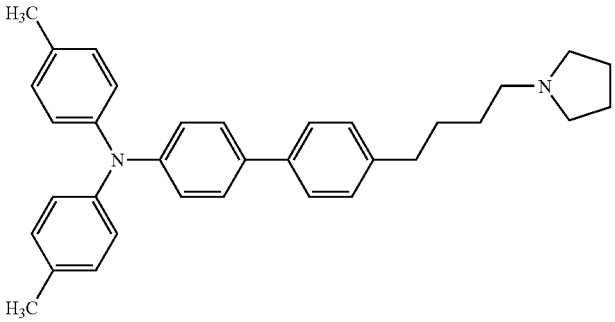 |
| 2-6 | 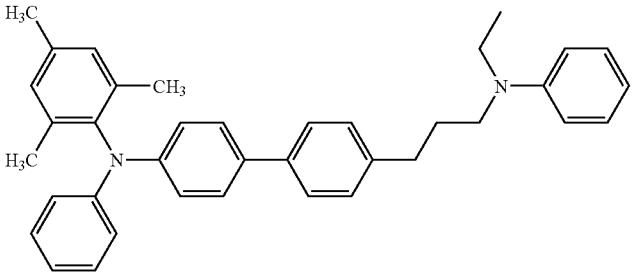 |
| 2-7 | 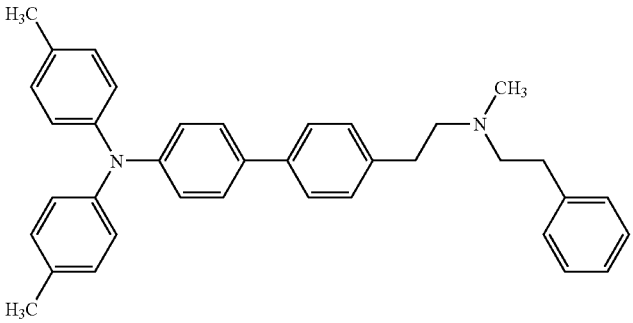 |
| 2-8 | 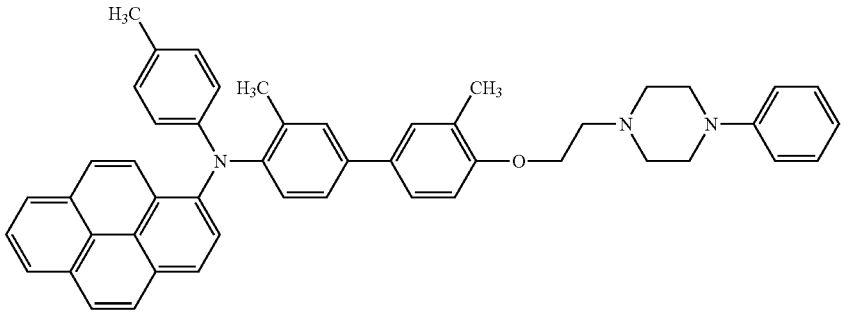 |

TABLE 2-continued

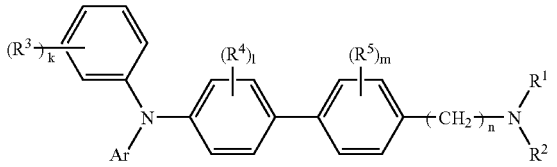

| Compound No. | Structural Formula |
|---|---|
| 2-9 | 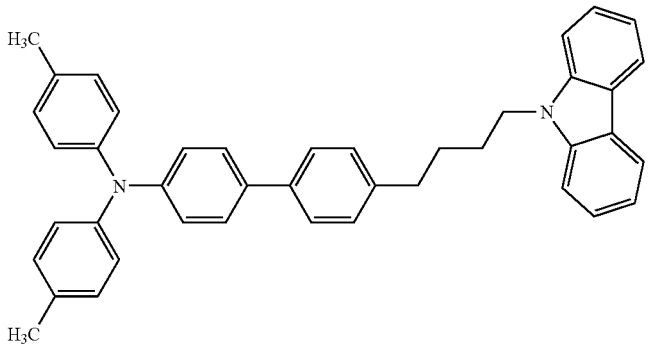 |
| 2-10 | 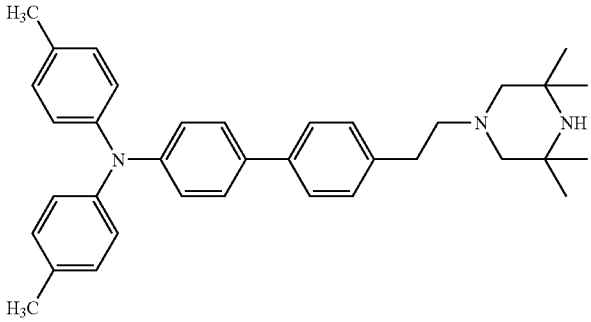 |
| 2-11 | 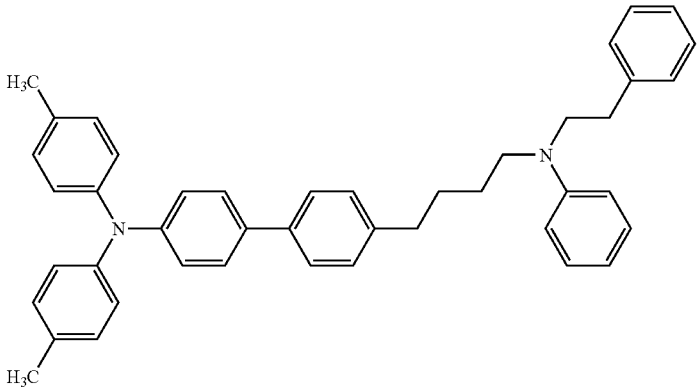 |

The addition amount of the compound represented by the general formulas 1 and 2 is preferably 0.01% by weight to 150% by weight relative to binder resin. If it is less than this, resistance to oxidizing gases is inadequate, and if it is more than this, film strength decreases and wear resistance properties deteriorate.

In a composition where the compound represented by the general formulas 1 and 2 is used in conjunction with the organic compound having an acid value of 10 mgKOH/g to 400 mgKOH/g, when it is required to store the coating solution, a special antioxidant must be added to suppress production of a salt due to mutual interactions. The production of this salt not only causes discoloration of the coating solution, but also leads to disadvantages such as residual potential rise in the manufactured electrophotographic photoconductor.

Although the common antioxidants and mentioned later can be used as the antioxidant in the present invention, (c) hydroquinone and (f) hindered amine compounds are particularly effective. However, the antioxidant used here, unlike the purpose described later, is used only to preserve the compounds represented by the general formulas 1 and 2 in the coating solution. Consequently, it is preferably added to the coating solution in a step prior to inclusion of the compounds represented by the general formulas 1 and 2, and in an addition amount of 0.1% by weight to 200% by weight relative to the organic compound having an acid value of 10 mgKOH/g to 400 mgKOH/g, sufficient coating solution storage stability over time can be obtained.

A polymer charge transport material having both a charge transport material function and a binder resin function, may conveniently be used in the charge transport layer. The charge transport layer which comprises such a polymer charge transport material excels in wear resistance. Although the polymer charge transport material may be a known material, a polycarbonate having a triarylamine structure in the main chain and/or side chain is very satisfactory. In particular, polymer charge transport materials of the following general formulas I to X perform well. These are illustrated below, together with specific examples.

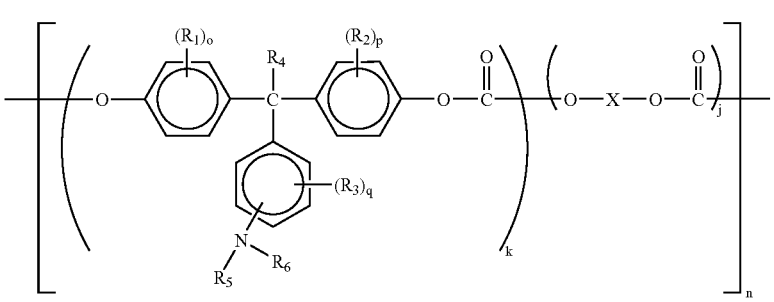

General Formula I in the formula, $R_1$, $R_2$, $R_3$ are respectively substituted or unsubsituted alkyl groups or halogen atoms, $R_4$ is a hydrogen atom or a substituted or unsubsituted alkyl group, $R_5$, $R_6$ are substituted or unsubsituted aryl groups, o, p, q are integers in the range of 0 to 4, k, j represent compositional fractions where $0.1 \leqq k \leqq 1$, $0 \leqq j \leqq 0.9$, n represents the number of repeating units and is an integer in the range 5 to 5000. X is an aliphatic divalent group, a cyclic aliphatic divalent group, or the divalent group shown by the following general formula:

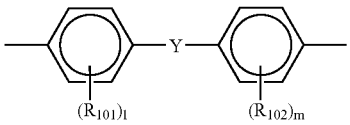

in the formula, $R_{101}$, $R_{102}$ are respectively substituted or unsubsituted alkyl groups, an aryl group, or a halogen atom, l, m are integers in the range of 0 to 4, Y is a single bond, straight-chain, branched or cyclic alkylene group having 1 to 12 carbon atoms, —O—, —S—, —SO—, —$SO_2$—, —CO—, —CO—O-Z-O—CO— (Z is an aliphatic divalent group), or:

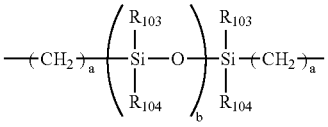

(a is an integer in the range of 1 to 20, b is an integer in the range of 1 to 2000, $R_{103}$, $R_{104}$ are substituted or unsubstituted alkyl groups or aryl groups). Herein, $R_{101}$, $R_{102}$, $R_{103}$, $R_{104}$ may be respectively identical or different.

General Formula II

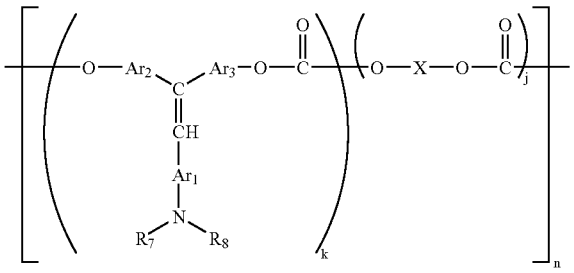

in the formula, $R_7$, $R_8$ are substituted or unsubstituted aryl groups, $Ar_1$, $Ar_2$, $Ar_3$ are allylene groups which may be identical or different, X, k, j and n are the same as in the general formula I.

General Formula III

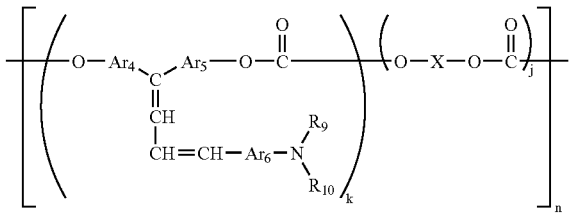

in the formula, $R_9$, $R_{10}$ are substituted or unsubstituted aryl groups, $Ar_4$, $Ar_5$, $Ar_6$ are allylene groups which may be identical or different, X, k, j and n are the same as in the general formula I.

General Formula IV

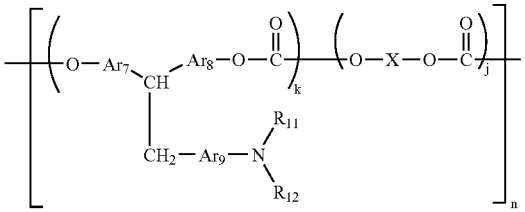

in the formula, $R_{11}$, $R_{12}$ are substituted or unsubstituted aryl groups, $Ar_7$, $Ar_8$, $Ar_9$ are allylene groups which may be identical or different, p is an integer in the range 1 to 5, X, k, j and n are t he same as in the general formula I.

General Formula V

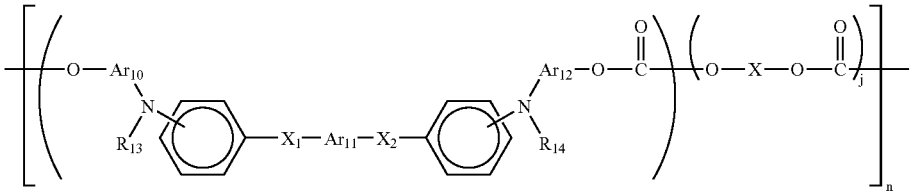

in the formula, $R_{13}$, $R_{14}$ are substituted or unsubstituted aryl groups, $Ar_{10}$, $Ar_{11}$, $Ar_{12}$ are allylene groups which may be identical or different, $X_1$, $X_2$ are substituted or unsubstituted ethylene groups, or substituted or unsubstituted vinylene groups. X, k, j and n are the same as in the general formula I.

General Formula VI

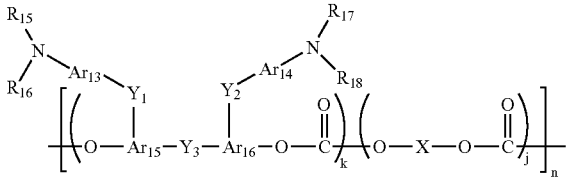

in the formula, $R_{15}$, $R_{16}$, $R_{17}$, $R_{18}$ are substituted or unsubstituted aryl groups, $Ar_1$, $Ar_2$, $Ar_3$ are allylene groups which may be identical or different, $Y_1$, $Y_2$, $Y_3$ are single bond, substituted or unsubstituted alkylene groups, substituted or unsubstituted cycloalkylene groups, substituted or unsubstituted alkylene ether groups, oxygen atoms, sulfur atoms or vinylene groups. X, k, j and n are the same as in the general formula I.

General Formula VII

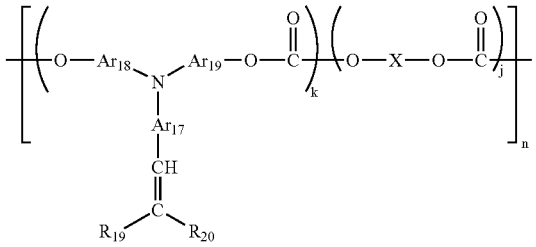

in the formula, $R_{19}$, $R_{20}$ are hydrogen atoms, or substituted or unsubstituted aryl groups, and $R_{19}$, $R_{20}$ may form a ring. $Ar_{17}$, $A_{18}$, $A_{19}$ are allylene groups which may be identical or different. X, k, j and n are the same as in the general formula I.

General Formula VIII

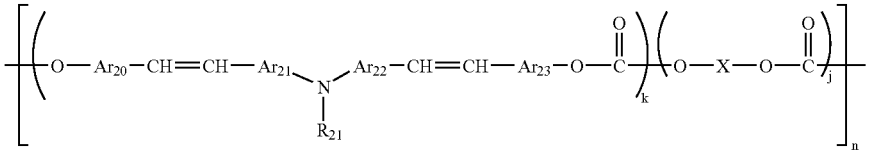

in the formula, $R_{21}$ is a substituted or unsubstituted aryl group, $Ar_{20}$, $Ar_{21}$, $Ar_{22}$, $Ar_{23}$ are allylene groups which may be identical or different, X, k, j and n are the same as in the general formula I.

General Formula IX

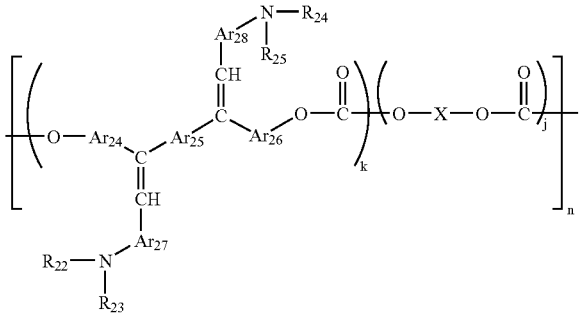

in the formula, $R_{22}$, $R_{23}$, $R_{24}$, $R_{25}$ are substituted or unsubstituted aryl groups, $Ar_{24}$, $Ar_{25}$, $Ar_{26}$, $Ar_{27}$, $Ar_{28}$ are allylene groups which may be identical or different. X, k, j and n are the same as in the general formula I.

General Formula X

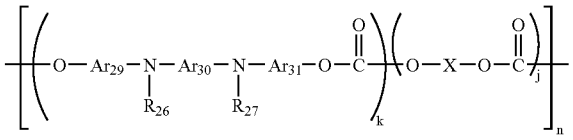

in the formula, $R_{26}$, $R_{27}$ are substituted or unsubstituted aryl groups, $Ar_{29}$, $Ar_{30}$, $Ar_{31}$ are allylene groups which may be identical or different. X, k, j and n are the same as in the general formula I.

The method of coating the coating solution obtained as described above, may be any of the techniques known in the art such as spray coating, beat coating, nozzle coating, spinner coating or ring coating. If the filler is contained in the photosensitive layer surface, the filler may be present throughout the photosensitive layer, but it is preferred to arrange a filler concentration gradient so that the filler concentration is highest on the outermost surface of the charge transport layer and lowest on the support side, or to arrange a gradually increasing filler concentration by providing plural charge transport layers from the support side to the surface side.

Next, the case where the photosensitive layer is a laminate (33) will be described. A photoconductor containing the aforesaid charge generating material dispersed in a binder resin, can be used. The photosensitive layer may be formed by dissolving or dispersing the charge generating material, charge transport material and binder resin in a suitable solvent, applying this, and drying. A plasticizer, levelling agent or antioxidant may also be added if necessary.

The binder resin, in addition to the binder resin described for the charge transport layer (37), may be used in admixture with the binder resin described for the charge generating layer (35). The aforementioned polymer charge transport material may of course also be used. The amount of charge generating material relative to 100 parts by weight of binder resin is preferably 5 parts by weight to 40 parts by weight, and the amount of charge transport material is preferably 0 part by weight to 190 parts by weight, and more preferably 50 parts by weight to 150 parts by weight. The photosensitive layer may be formed by applying a coating solution wherein the charge generating material and binder resin are dispersed together with the charge transport material by a disperser or the like using a solvent such as tetrahydrofuran, dioxane, dichloroethane or cyclohexane. The thickness of the photosensitive layer may conveniently be of the order of 5 μm to 25 μm.

In the composition where the photosensitive layer is the outermost surface layer, it is effective if the filler is contained in at least the photosensitive layer surface to improve wear resistance. In this case, any of the fillers used in the charge transport layer (37) may be used. Also in this case, although the filler may be contained throughout the photosensitive layer, it is effective to arrange a filler concentration gradient, or to provide plural photosensitive layers and gradually vary the filler concentration as in the case of the charge transport layer.

In the photoconductor of the present invention, an underlayer can be provided between the conductive support (31) and the photosensitive layer. Although the underlayer generally uses a resin as principal component, considering that a photosensitive layer will be applied onto it with a solvent, it is preferred that it is a resin with high solvent resistance rather than a common organic solvent. Examples of such resins are water-soluble resins such as polyvinyl alcohol, casein, sodium polyacrylate, alcohol-soluble resins such as copolymer nylon and methoxymethylated nylon, and curing resins which form a three-dimensional network such as polyurethane, melamine resin, phenol resin, alkyde-melamine resin and epoxy resin. Also, metal oxide fine powder pigments such as titanium oxide, silica, alumina, zirconium oxide, tin oxide or indium oxide may also be added to the underlayer to prevent Moire patterns, and to reduce residual potential.

These underlayers can be formed using a suitable solvent and coating method as for the above-mentioned photosensitive layer. A silane coupling agent, titanium coupling agent or chromium coupling agent, etc. can be used as the underlayer of the present invention. $Al_2O_3$ prepared by anodic oxidation, organic materials such as polyparaxylylene (parylene) and inorganic materials such as $SiO_2$, $SnO_2$, $TiO_2$, ITO, $CeO_2$ prepared by the vacuum thin film-forming method, can be used for the underlayer of the present invention. Other materials known in the art may also be used. The film thickness of the underlayer is in the range of 0 μm to 5 μm.

In the photoconductor of the present invention, a protective layer (39) may be provided on the photosensitive layer to protect the photosensitive layer. Examples of materials used for the protective layer (39) are resins such as ABS resin, ACS resin, olefine-vinyl monomer copolymer, chlorinated polyether, aryl resin, phenol resin, polyacetal, polyamide, polyamidoimide, polyacrylate, polyallyl sulfone, polybutylene, polybutylene terephthalate, polycarbonate, polyethersulfone, polyethylene, polyethylene terephthalate, polyimide, acrylic resin, polymethylpentene, polypropylene, polyphenylene oxide, polysulfone, polystyrene, polyarylate, AS resin, butadiene-styrene copolymer, polyurethane, polyvinyl chloride, polyvinylidene chloride and epoxy resin. From the viewpoint of filler dispersibility, residual potential and film defects, polycarbonate or polyarylate are particularly effective and useful.

The filler material is added to the protective layer of the photoconductor in order to improve wear resistance. Any of the filler materials contained in the charge transport layer

(37) can be used as the filler material used here. Of these, inorganic pigments are preferred from the viewpoint of wear resistance, and metal oxides having a pH of 5 or more and a dielectric constant of 5 or more are more preferred as they strongly suppress image blurring. Examples of these insulating fillers are titanium oxide, alumina, zinc oxide and zirconium dioxide. A filler having a pH of 5 or a filler having a dielectric constant of 5 or more can of course be used alone, but fillers having a pH of less than 5 may be combined with fillers having a pH of 5 or more, and fillers having a dielectric constant of less than 5 may be combined with fillers having a dielectric constant of 5 or more. Also, of these filler materials, α-alumina may be mentioned as a particularly useful filler. It is particularly useful due to its highly insulating properties, high thermal stability and high hardness which give it superior wear resistance, and because it does not easily agglomerate.

These fillers can be given a surface treatment with at least one type of finishing agent, and this is preferred from the viewpoint of filler dispersibility. Regarding the finishing agent, any of the materials applied to the charge transport layer (37) can be used. The surface treatment agent may be used alone, or two or more types may be used in admixture. Regarding the amount of surface treatment, the amount applied to the charge transport layer (37) can be used.

The organic compound having an acid value of 10 mgKOH/g to 400 mgKOH/g may be any of those compounds listed for the charge transport layer (37). A polycarboxylic acid may be any organic compound which contains at least a carboxylic acid or a derivative thereof, and copolymers using a polyester resin, acrylic resin, acrylic resin or methacrylic resin, or a styrene-acrylic copolymer, are more useful. A straight chain organic fatty acid may be used alone, or it may be mixed with a polycarboxylic acid, in which case the filler dispersibility enhancement effect may be increased. The organic compound having an acid value of 10 mgKOH/g to 400 mgKOH/g can be one of a polyester resin, acrylic resin, a copolymer comprising these structures, and a mixture thereof.

The addition amount of the organic compound having an acid value of 10 mgKOH/g to 400 mgKOH/g is 0.01% by weight to 50% by weight and preferably 0.1% by weight to 20% by weight relative to the added filler, and it is more preferred to set it to the minimum required amount. If the addition amount is larger than necessary, an effect of image blurring may appear, and if the addition amount is too small, the residual potential reduction effect is not observed. Also, the acid value of the organic compound is 10 mgKOH/g to 400 mgKOH/g and preferably 30 mgKOH/g to 200 mgKOH/g, but this must be determined taking account of a balance with the addition amount. If the acid value is higher than this, image blurring may appear more easily, and if the acid value is low, the residual potential reduction effect is less and sufficient effect may not be obtained even if the addition amount is increased. However, the acid value of the material does not directly influence the residual potential reduction effect, this being largely dependent on the structure or molecular weight of the organic compound used, and the filler dispersibility.

The compound represented by the general formulas 1 and 2 which is added to improve oxidizing gas resistance may be any of those listed for the charge transport layer (37).

The solvent used may be any of the solvents used for the charge transport layer (37), such as tetrahydrofuran, dioxane, toluene, dichloromethane, monochlorobenzene, dichloroethane, cyclohexanone, methyl ethyl ketone and acetone. However, although a solvent with high viscosity is preferred for the dispersion, a solvent with high volatility is preferred for coating. If there is no solvent which satisfies these conditions, it is possible to use a mixture of two or more solvents each having different physical properties, and this may have a large effect on filler dispersibility and residual potential.

The addition to the protective layer of the low molecular weight charge transport materials or high molecular weight charge transport materials mentioned for the charge transport layer (37), is effective and useful for reducing residual potential and improving image quality.

The filler materials may be dispersed together with the organic compound having an acid value of 10 mgKOH/g to 400 mgKOH/g using a method known in the art such as a ball mill, attritor, sand mill or ultrasonic waves. Of these, dispersion by ball mill is more preferred from the viewpoint of dispersibility as it permits higher contact efficiency between the filler and the organic compound having an acid value of 10 mgKOH/g to 400 mgKOH/g, and introduction of impurities from outside is less. The media used may be any of the media used in the art such as zirconia, alumina or agate, but from the viewpoint of filler dispersibility and residual potential decrease effect, alumina is more preferred. If zirconia is used, the wear amount of the media during dispersion is large, and residual potential considerably increases when these are added. Further, dispersibility considerably decreases due to the addition of this abrasion powder, and filler sedimentation is promoted. On the other hand, if alumina is used as the media, although the media does suffer wear during dispersion, the wear amount is suppressed low, and the abrasion powder which is added has an extremely small effect on residual potential. Moreover, the adverse effect on dispersibility is small even if abrasion powder is added. Therefore, the use of alumina as the media used for dispersion is more preferred.

By adding the organic compound having an acid value of 10 mgKOH/g to 400 mgKOH/g together with the filler and organic solvent, filler cohesion and filler sedimentation in the coating solution are suppressed and filler dispersibility is remarkably improved, so it is preferred to add it prior to dispersion. The binder resin and charge transport material may also be added prior to dispersion, but in this case, the dispersibility may slightly decrease. Therefore, the binder resin and charge transport material are preferably added dissolved in the organic solvent after dispersion. Moreover, in order to preserve the compounds represented by the general formulas 1 and 2 in the coating solution, one or more antioxidants which are the same as the ones described in the section of charge transport layer may be added.

From the viewpoint of the optical transmittance and wear resistance properties of the protective layer, the average first-order particle diameter of the filler is preferably 0.01 μm to 0.5 μm. If the average first-order particle diameter of the filler is less than 0.01 μm, wear resistance properties decrease and dispersibility decreases, whereas if it is more than 0.5 μm, filler sedimentation may be promoted and toner filming may occur.

The protective layer may be formed by a method known in the art such as impregnation coating, spray coating, beat coating, nozzle coating, spinner coating and ring coating, but from the viewpoint of uniformity of the film, spray coating is more preferred. The required film thickness of the protective layer may be coated in one operation to form the protective layer, but from the viewpoint of uniformity of the filler in the film, it is more preferred to apply the coating solution two or more times so as to form plural protective layers. By so doing, an enhanced effect is obtained regarding residual potential reduction, resolution increase and wear resistance improvement. The thickness of the protective layer may conveniently be of the order of 0.1 μm to 10 μm. In the present invention, by adding the organic compound having an acid value of 10 mgKOH/g to 400 mgKOH/g, the residual potential can be largely reduced, so the film thickness of the protective layer can be freely set. However, if the protective layer film thickness is increased too much, the image quality tends to deteriorate slightly, so it is preferred to set it to the minimum required film thickness.

In the photoconductor of the present invention, an interlayer can also be provided between the photosensitive layer and protective layer. This interlayer generally has a binder resin as its main component. Examples of this resin are polyamide, alcoholic-soluble nylon, water-soluble polyvinyl butyral, polyvinyl butyral and polyvinyl alcohol. The interlayer may be formed by any of the coating methods generally used as described above. The thickness of the interlayer may conveniently be of the order of 0.05 μm to 2 μm.

In the present invention, to improve weatherability and in particular to prevent decrease of sensitivity and increase of residual potential, an antioxidant, a plasticizer, a lubricant, an ultraviolet absorber, a low molecular weight charge transport material and a levelling agent can be added to any of the layers, i.e., the charge generating layer, charge transport layer, underlayer, protective layer and interlayer. Examples of these compounds are given below.

Examples of antioxidants which can be added to each layer are the following, although these are not exhaustive:

(a) Phenol Compounds 2,6-di-t-butyl-p-cresol, butylated hydroxyanisole, 2 6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene bis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl) butylic acid]crecol ester, and tocopherols.

(b) Paraphenylenediamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine.

(c) Hydroquinones 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, 2-(2-octadecenyl-5-methyl hydroquinone.

(d) Organosulfur Compounds dilauryl-3,3'-thiodipropionate, distearyl-3,3'-thiodipropionate, ditetradecyl-3,3'-thiodipropionate.

(e) Organophosphorus Compounds

Triphenylphosphine, tri(nonylphenyl)phosphine, tri(dinonylphenyl)phosphine, tricresylphosphine, tri(2,4-dibutylphenoxy)phosphine.

Examples of plasticizers which can be added to each layer as the following, although these are not exhaustive:

(a) Phosphate Plasticizers

Triphenyl phosphate, tricresyl phosphate, trioctyl phosphate, octyldiphenyl phosphate, trichlorethyl phosphate, cresyldiphenyl phosphate, tributyl phosphate, tri-2-ethylhexyl phosphate, triphenyl phosphate.

(b) Phthalate Ester Plasticizers

Dimethyl phthalate, diethyl phthalate, diisobutyl phthalate, dibutyl phthalate, diheptyl phthalate, di-2-ethyl hexyl phthalate, diisooctyl ester phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloctyl phthalate, octyldecyl phthalate, dibutyl fumarate, dioctyl fumarate.

(c) Aromatic Carboxylic Acid Ester Plasticizers

Trioctyl trimellitate, tri-n-octyl trimellitate, octyl oxybenzoate.

(d) Aliphatic Dibasic Acid Ester Plasticizers

Dibutyl adipate, di-n-hexyl adipate, di-2-ethylhexyl adipate, di-n-octyl adipate, n-octyl-n-decyl adipate, diisodecyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate.

(e) Fatty Acid Ester Derivatives

Butyl oleate, glycerol monochrome oleate, acetyl methyl ricinoleate, pentaerythritol ester, dipentaerythritol hexaester, triacetin, tributylene.

(f) Oxyacid Ester Plasticizers

Acetyl methyl ricinoleate, acetyl butyl ricinoleate, butyl phthalyl butyl glycolate, acetyl tributyl citrate.

(g) Epoxy Plasticizers

Epoxidized soybean oil, epoxidized flaxseed oil, epoxy butyl stearate, epoxy decyl stearate, epoxy octyl stearate, epoxy benzyl stearate, epoxy dioctyl hexahydrophthalate, epoxy didecyl hexahydrophthalate.

(h) Dihydric Alcohol Ester Plasticizers

Diethylene glycol dibenzoate, triethylene glycol di-2-ethyl butyrate.

(i) Chlorine-Containing Plasticizers

Chlorinated paraffin, chlorinated diphenyl, chlorinated methyl fatty acids, methoxychlorinated methyl fatty acids.

(j) Polyester Plasticizers

Polypropylene adipate, polypropylene sebacate, polyester, acetylated polyester.

(k) Sulfonic Acid Derivatives p-toluenesulfonamide, o-toluenesulfonamide, p-toluene sulfone ethylamide, o-toluene sulfone ethyl amide, toluene sulfone-N-ethylamide, p-toluene sulfone-N-cyclohexylamide.

(l) Citric Acid Derivatives

Triethyl citrate, acetyl triethyl citrate, tributyl citrate, acetyl tributyl citrate, acetyl tri-2-ethylhexyl citrate, acetyl n-octyldecyl citrate.

(m) Other

Terphenyl, partially hydrated terphenyl, camphor, 2-nitrodiphenyl, dinonylnaphthalene, methyl abietate.

Examples of lubricants which can be added to each layer are the following, although these are not exhaustive:

(a) Hydrocarbon Compounds

Liquid paraffin, paraffin wax, micro wax, low molecular weight polyethylene.

(b) Fatty Acid Compounds

Lauric acid, myristic acid, palmitic acid, stearic acid, arachidic acid, behenic acid.

(c) Fatty Acid Amide Compounds

Stearyl amides, palmityl amides, olein amides, methylene bis-stearoamides, ethylene bis-stearoamides.

(d) Ester Compounds

Lower alcohol esters of fatty acids, polyhydric alcohol esters of fatty acids, polyglycol esters of fatty acids.

(e) Alcohol Compounds

Cetyl alcohol, stearyl alcohol, ethylene glycol, polyethylene glycol, polyglycerol.

(f) Metal Soaps

Lead stearate, stearic acid cadmium, barium stearate, calcium stearate, zinc stearate, magnesium stearate.

(g) Natural Wax

Carnauba wax, candelilla wax, beeswax, spermaceti wax, Chinese wax, montan wax.

(h) Other

Silicone compounds, fluorine compounds.

Examples of ultraviolet absorbers which can be added to each layer are the following, although these are not exhaustive:

(a) Benzophenones 2-hydroxybenzophenone, 2,4-dihydroxybenzophenone, 2,2',4-trihydroxybenzophenone, 2,2'4,4'-tetrahydroxybenzophenone, 2,2'-dihydroxy-4-methoxybenzophenone.

(b) Salicylates

Phenylsalicylate, 2,4-di-t-butylphenyl, 3,5-di-t-butyl-4-hydroxybenzoate.

(c) Benzotriazoles (2'-hydroxyphenyl)benzotriazole, (2'-hydroxy-5'-methylphenyl)benzotriazole, (2'-hydroxy-5'-methylphenyl)benzotriazole, (2'-hydroxy-3'-tert-butyl-5'-methylphenyl)benzotriazole (d) Cyanoacrylates Ethyl-2-cyano-3,3-diphenylacrylate, methyl-2-carbomethoxy-3-(p-methoxy)acrylate.

(e) Quenchers (Metal Complexes)

Nickel (2,2'-thiobis(4-t-octyl) phenolate)-n-butylamine, nickel dibutyl dithiocarbamate, nickel dibutyl dithiocarbamate, cobalt dicyclohexyldithiophosphate.

(f) HALS (Hindered Amines)

Bis-(2,2,6,6-tetramethyl-4-piperidyl) sebacate, bis-(1 2,2,6,6-pentamethyl-4-piperidyl) sebacate, 1-[2-[3-(3,5-di-t-butyl-4-hydroxyphenyl)propionyloxy]ethyl]-4-[3-(3,5-di-t-butyl-4-hydroxyphenyl)propionyloxy-]-2,2,6,6-tetramethylpyridine, 8-benzyl-7,7,9,9-tetramethyl-3-octyl-1,3,8-triazaspiro[4,5]undecane-2,4-dione, 4-benzoyl oxy-2,2,6,6-tetramethylpiperidine.

Next, the electrophotography method and electrophotographic apparatus of the present invention will be described in detail referring to the drawings.

Figure 6:
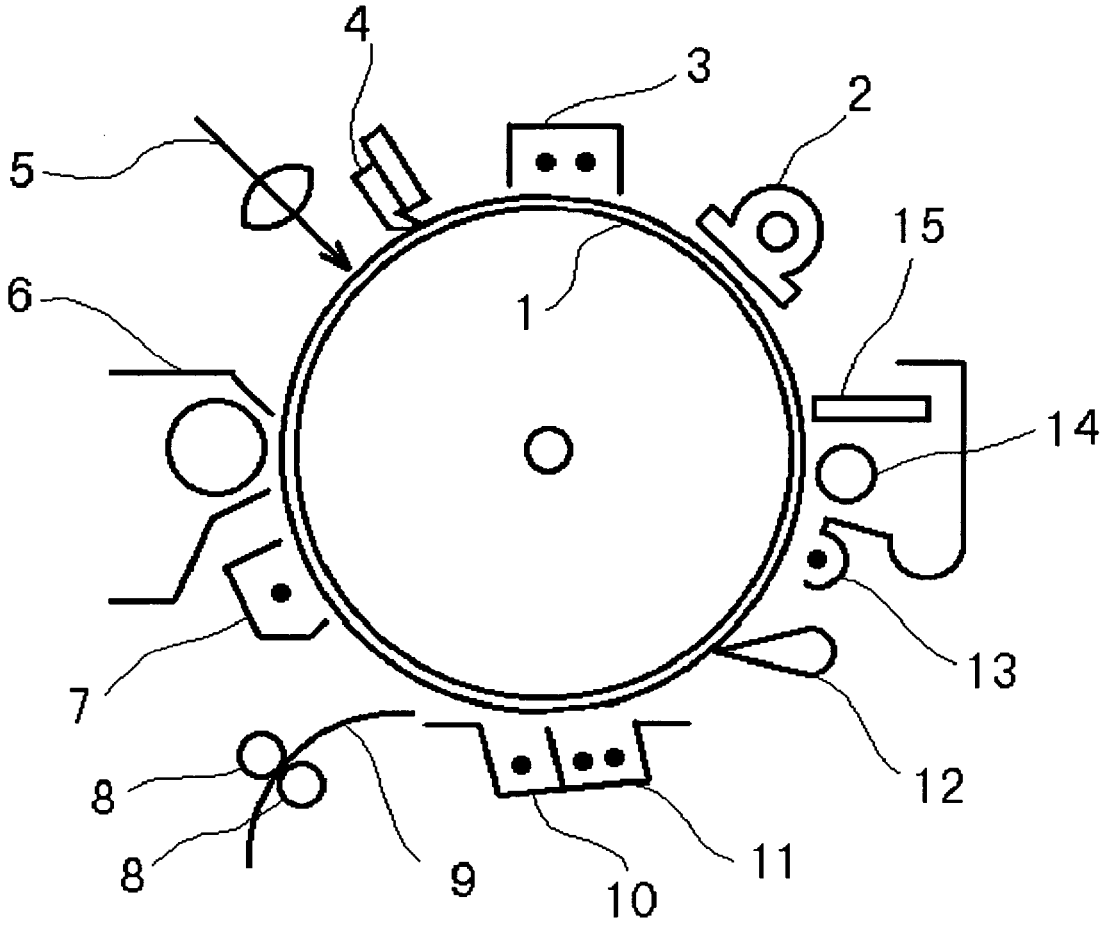
FIG. 6 is a diagram of an example for the purpose of describing the electrophotography process and electrophotography apparatus according to the present invention.

FIG. 6 is a schematic diagram for the purpose of describing the electrophotography process and electrophotography apparatus of the present invention, the following examples also being within the scope of the present invention.

In FIG. 6, the photoconductor (1) is provided with at least the photosensitive layer which contains a filler in the outermost surface layer. The photoconductor (1) has a drum-like shape, but may also be in the form of a sheet, or an endless belt. A corotron, scorotron, solid state charger or charging roller is used for the charging charger (3), pre-transfer charger (7), transfer charger (10), separation charger (11) and pre-cleaning charger (13), and any of the methods known in the art may be used.

The transfer means is generally one of the aforesaid chargers, but the combination of a transfer charger and separation charger is effective as shown in the figure.

The light sources such as an image exposure part (5) and charge eliminating lamp (2) may be any light-emitting devices, such as a fluorescent lamp, tungsten lamp, halogen lamp, mercury-vapor lamp, sodium lamp, light emitting diode (LED), semiconductor laser (LD) or electroluminescence (EL). In order to irradiate only light of a desired wavelength band, various filters such as a sharp cut filter, band pass filter, near-infrared cut-off-filter, dichroic filter, interference filter and color conversion filter, can also be used. The exposure step can employ a "digital method" where the latent electrostatic image is written on the electrophotographic photoconductor by a LD or LED.

The light source irradiates the photoconductor with light for providing a transfer step, charge eliminating step cleaning step or pre-exposure and other steps in conjunction with light irradiation, in addition to the steps shown in FIG. 6.

The toner developed on the photoconductor (1) by a development module (6) is transferred to the transfer paper (9), but not all of it is transferred, and some toner remains on the photoconductor (1). This toner is removed from the photoconductor by a fur brush (14) and braid (15). Cleaning may also be performed only by the cleaning brush, the cleaning brush being any of those known in the art including a fur brush and magnetic fur brush. 4 is an eraser, 8 is a resist roller and 12 is a separating tongue.

When the electrophotographic photoconductor is positively (negatively) charged and image exposure is performed, a positive (negative) latent electrostatic image is formed on the photoconductor surface. If this is developed with toner (charge-seeking particulates) of negative (positive) polarity, a positive image will be obtained, and if it is developed with toner of positive (negative) polarity, a negative image will be obtained.

The development means may be any of those known in the art, and the charge eliminating means may also be any of those known in the art.

Figure 7:
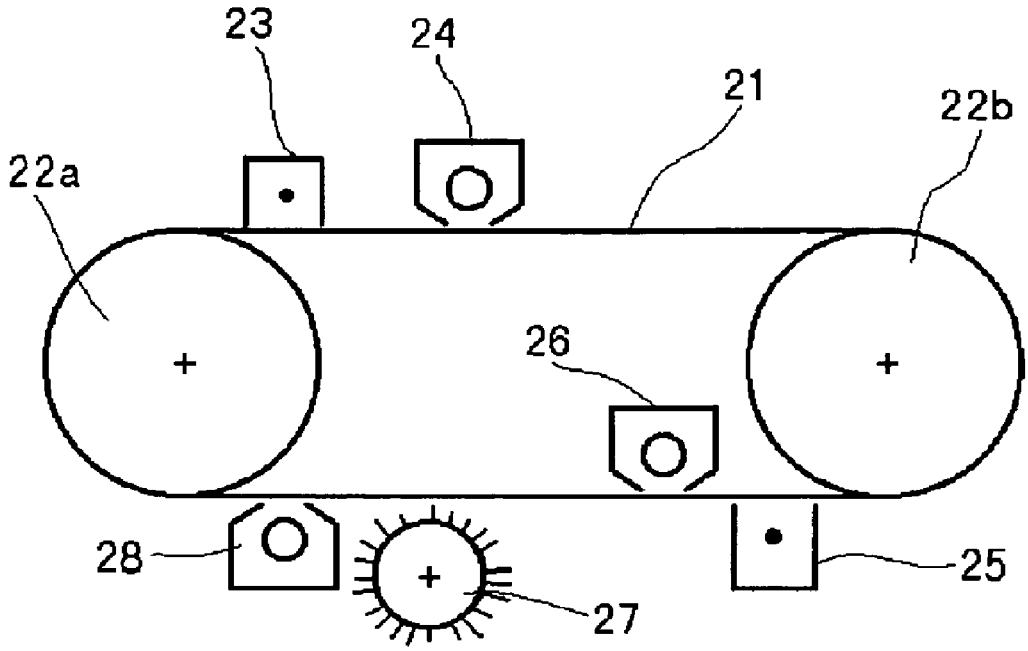
FIG. 7 is a diagram of an example for the purpose of describing another electrophotography process and electrophotography apparatus according to the present invention.

FIG. 7 shows another example of the electrophotography process of the present invention.

A photoconductor (21) comprises at least a photosensitive layer, and contains a filler in the outermost surface layer. Driving by drive rollers (22*a*) and (22*b*), charging by a charger (23), image exposure by a light source (24), development (not shown), transfer by a charger (25), pre-cleaning exposure by a light source (26), cleaning by a brush (27) and charge elimination by a light source (28) are repeatedly performed. In FIG. 7, the photoconductor (21) is irradiated by pre-cleaning exposure light from the carrier side (of course, in this case the carrier is translucent).

The electrophotographic process shown in the above figures illustrates one aspect of the present invention, but other aspects are of course possible. For example, although cleaning pre-exposure is performed from the carrier side in FIG. 7, this may be performed from the photosensitive layer side, and image exposure and charge elimination light irradiation may be performed from the carrier side.

Further, although image exposure, cleaning pre-exposure and charge elimination exposure are illustrated, pre-transfer exposure, pre-exposure for image exposure and other irradiation steps known in the art may also be provided to optically irradiate the photoconductor.

Figure 8:
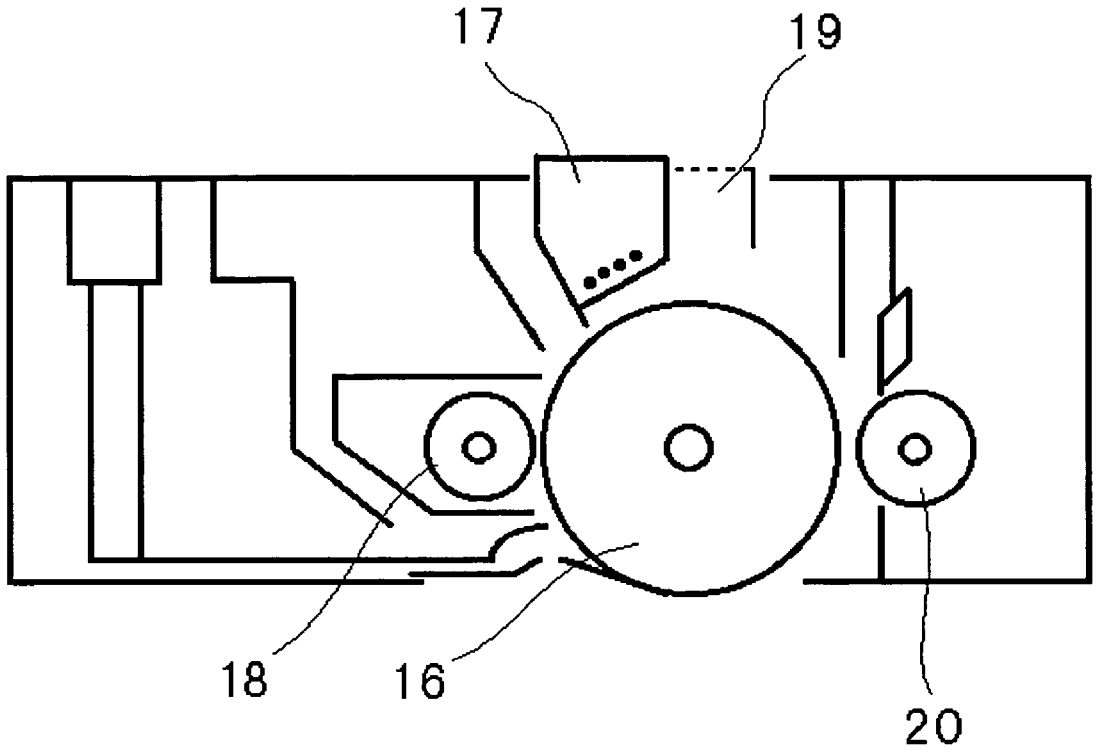
FIG. 8 is a diagram of an example for the purpose of describing the electrophotography process and electrophotography apparatus according to the present invention.

The image-forming means shown above may be fixed and incorporated in a copier, facsimile or printer, and it may also be incorporated in these devices in the form of a process cartridge. A process cartridge is a single apparatus (part) containing a built-in photoconductor, and may also include a charging means, exposure means, development means, transfer means, cleaning means and charge eliminating means if required. The process cartridge may take many forms, but that shown in FIG. 8 is given as a general example. A photoconductor (16) has at least a photosensitive layer on a conductive support, and contains a filler in the outermost surface layer. It also comprises a charging charger (17), cleaning brush (18) image exposure part (19) and developer unit (20) surrounding the photoconductor (16) in a one-piece construction.

EXAMPLES

Hereafter, the present invention will be described by way of specific examples, but it should be understood that the present invention is not limited in any way thereby. All parts are parts by weight.

Example 1

An underlayer coating solution, charge generating layer coating solution and charge transport layer coating solution having the following compositions were applied and dried one by one by immersion coating to form a 3.5 μm underlayer, 0.2 μm charge generating layer and 23 μm charge transport layer on an aluminum cylinder.

| | |
|---|---|
| Underlayer coating solution | |
| Titanium dioxide powder | 400 parts |
| Melamine resin | 65 parts |
| Alkyd resin | 120 parts |
| 2-butanone | 400 parts |
| Charge generating layer coating solution | |
| Bis-azo pigment having the following structure | 12 parts |

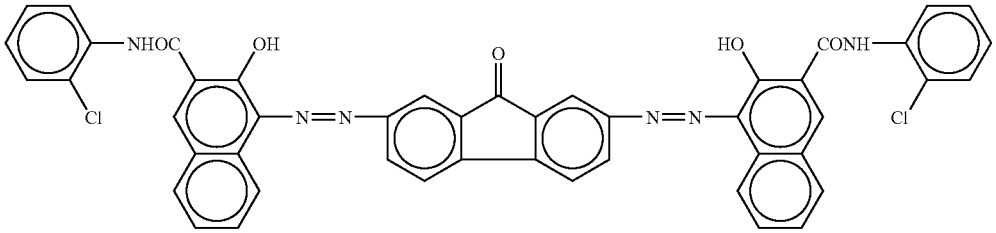

| | |
|---|---|
| Polyvinyl butyral | 5 parts |
| 2-butanone | 200 parts |
| Cyclohexanone | 400 parts |
| Charge transport layer coating solution | |
| Polycarbonate (Z Polycarb, Teijin Chemicals Ltd.) | 10 parts |
| Charge transport material having the following structural formula | 10 parts |

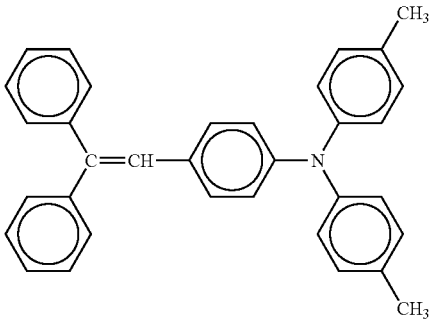

| | |
|---|---|
| Tetrahydrofuran | 100 parts |

An approx. 4 μm protective layer was further formed by spray coating the following composition on the charge transport layer, and the electrophotography photoconductor 1 was thereby manufactured.

| | |
|---|---|
| Protective layer coating solution | |
| Alumina (average first-order particle diameter: 0.3 μm, Sumitomo Chemical Co., Ltd.) | 2 parts |

-continued

| | |
|---|---|
| Compound expressed by Compound 1-1 | 0.5 parts |
| Unsaturated polycarboxylic acid polymer solution (acid value 180 mg KOH/g, BYK Chemie GmbH) | 0.02 parts |
| Charge transport material having the following structural formula | 3.5 parts |

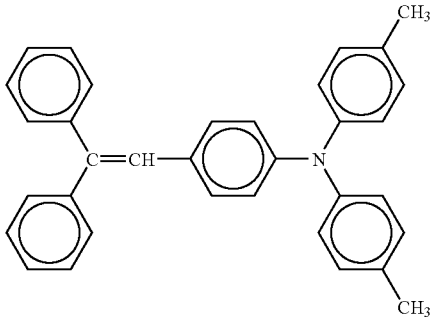

| | |
|---|---|
| Polycarbonate (Z Polycarb, Teijin Chemicals Ltd.) | 6 parts |
| Tetrahydrofuran | 220 parts |
| Cyclohexanone | 80 parts |

Example 2

An electrophotographic photoconductor 2 was manufactured exactly as in Example 1, except that the polycarboxylic acid contained in the protective layer was replaced by the following material.

Unsaturated Polycarboxylic Acid Polymer (Acid value 365 mgKOH/g, BYK Chemie GmbH) 0.02 parts Example 3

An electrophotographic photoconductor 3 was manufactured exactly as in Example 1, except that the polycarboxylic acid contained in the protective layer was replaced by the following material.

Polyester resin (acid value 35 mgKOH/g) 0.2 parts

Example 4

An electrophotographic photoconductor 4 was manufactured exactly as in Example 1, except that the polycarboxylic acid contained in the protective layer was replaced by the following material.

Polyester resin (acid value 50 mgKOH/g) 0.2 parts

Example 5

An electrophotographic photoconductor 5 was manufactured exactly as in Example 1, except that the polycarboxylic acid contained in the protective layer was replaced by the following material.

Acrylic resin (acid value 65 mgKOH/g) 0.1 parts

Example 6

An electrophotographic photoconductor 6 was manufactured exactly as in Example 1, except that the polycarboxylic acid contained in the protective layer was replaced by the following material.

Acrylic acid/hydroxyethyl methacrylate copolymer (acid value 50 mgKOH/g) 0.1 parts Example 7

An electrophotographic photoconductor 7 was manufactured exactly as in Example 1, except that the polycarboxylic acid contained in the protective layer was replaced by the following material.

Maleic acid monoalkyl/styrene/butyl acrylate (acid value 50 mgKOH/g) 0.1 parts

Example 8

An electrophotographic photoconductor 8 was manufactured exactly as in Example 1, except that the polycarboxylic acid contained in the protective layer was replaced by the following material.

Styrene-acrylic copolymer (acid value 200 mgKOH/g) 0.1 parts

Example 9

An electrophotographic photoconductor 9 was manufactured exactly as in Example 1, except that the addition amount of carboxylic acid contained in the protective layer was changed to the following amount.

Unsaturated Polycarboxylic Acid Polymer Solution (acid value 365 mgKOH/g, BYK Chemie GmbH) 0.002 parts Example 10

An electrophotographic photoconductor 10 was manufactured exactly as in Example 5, except that the addition amount of acrylic resin contained in the protective layer was changed to the following amount.

Acrylic resin (acid value 65 mgKOH/g) 0.5 parts

Example 11

An electrophotographic photoconductor 11 was manufactured exactly as in Example 1, except that the filler contained in the protective layer was replaced by the following material.

Titanium oxide (average first-order particle diameter 0.3 μm, Ishihara Sangyo Kaisha, Ltd.) 2 parts Example 12

An electrophotographic photoconductor 12 was manufactured exactly as in Example 1, except that the filler contained in the protective layer was replaced by the following material.

Silane coupling-treated titanium oxide (average first-order particle diameter 0.015 μm, treatment amount 20%) 2 parts Example 13

An electrophotographic photoconductor 13 was manufactured exactly as in Example 1, except that the filler contained in the protective layer was replaced by the following material.

Silica (average particle diameter 0.015 μm, Shin-Etsu silicone) 2 parts

Example 14

An electrophotographic photoconductor 14 was manufactured exactly as in Example 1, except that the charge transport material and binder resin contained in the protective layer was replaced by the following material.

Polymer charge transport material having the following structural formula 20 parts

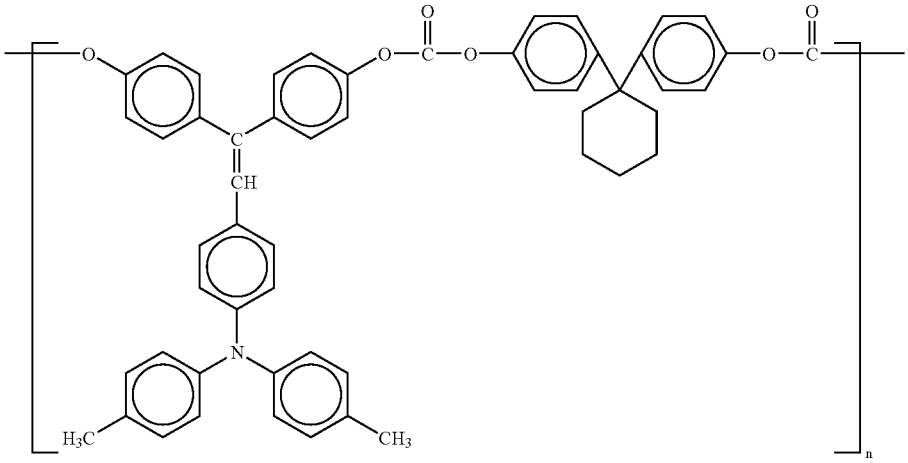

Example 15

An electrophotographic photoconductor 15 was manufactured exactly as in Example 1, except that the binder resin contained in the protective layer was replaced by the following material.

Polyarylate resin (U polymer, Unitika Ltd.) 10 parts

Example 16

An electrophotographic photoconductor 16 was manufactured exactly as in Example 1, except that the charge generating layer coating solution, charge transport layer coating solution and protective layer coating solution were modified as follows.

Figure 9:
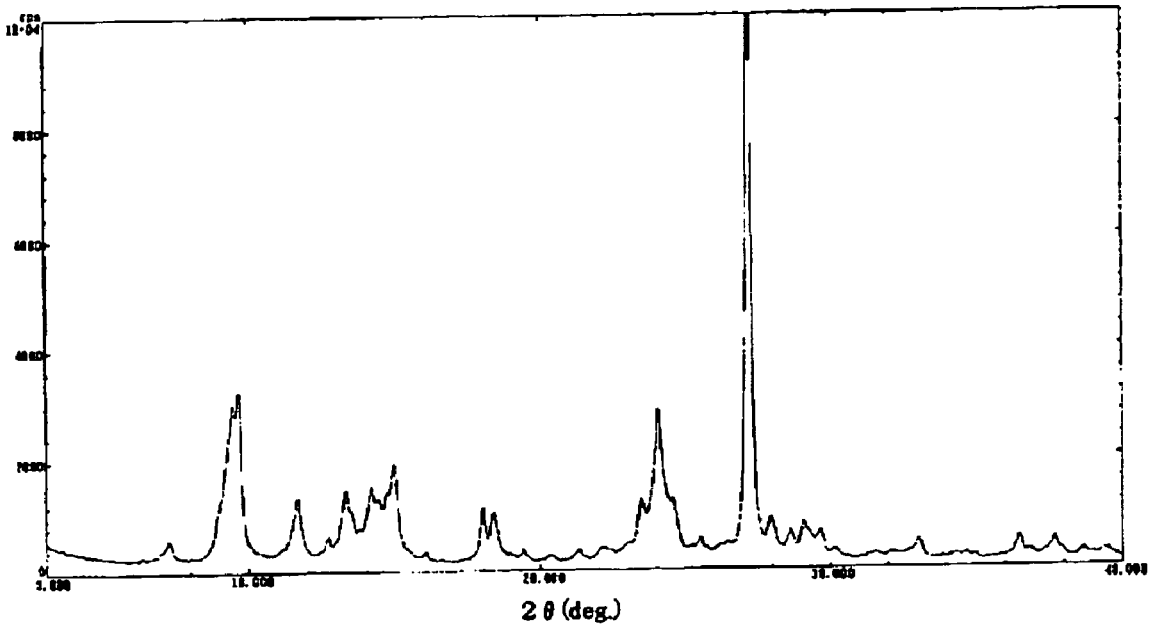
FIG. 9 is a diagram showing the XD spectrum of titanyl phthalocyanine used in Embodiment 16.

| | |
|---|---|
| Charge generating layer coating solution | |
| Titanyl phthalocyanine having the XD spectrum of FIG. 9 | 8 parts |
| Polyvinyl butyral | 5 parts |
| 2-butanone | 400 parts |
| Charge transport layer coating solution | |
| C type polycarbonate | 10 parts |
| Charge transport material having the following structural formula | 8 parts |

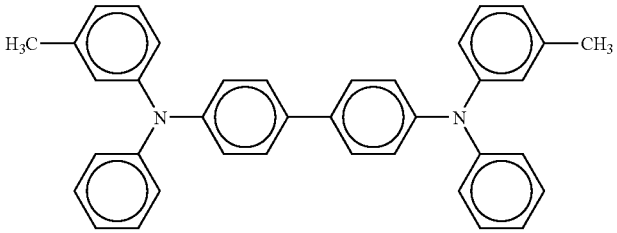

| | |
|---|---|
| Toluene | 70 parts |
| Protective layer coating solution | |
| Alumina-treated titanium oxide (average first-order particle diameter 0.035 μm, Tayca Corporation) | 1.5 parts |
| Compound represented by the Compound 1-1 | 0.5 parts |
| Methacrylic acid/methyl methacrylate copolymer (acid value 50 mg KOH/g) | 0.5 parts |
| C type polycarbonate (Teijin Chemicals Ltd.) | 5.5 parts |
| Charge transport material having the following structural formula | |

-continued

| | |
|---|---|
| 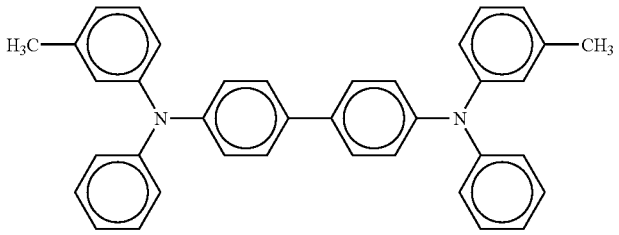 | 4 parts |
| Tetrahydrofuran | 250 parts |
| Cyclohexanone | 50 parts |

Comparative Example 1

An electrophotographic photoconductor 17 was manufactured exactly as in Example 1, except that the protective layer-forming coating solution was replaced by the following composition.

| Protective layer coating solution | |
|---|---|
| Alumina (average first-order particle diameter: 0.3 μm, Sumitomo Chemical Co., Ltd.) | 2 parts |
| Compound expressed by Compound 1-1 | 0.5 parts |
| Charge transport material having the following structural formula | 4 parts |
| 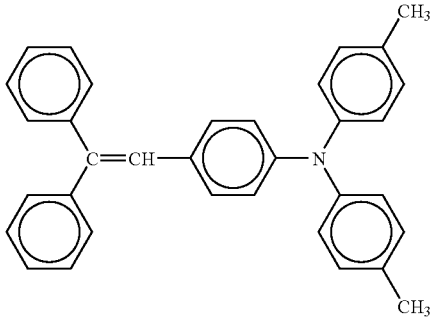 | |
| Polycarbonate (Z Polycarb, Teijin Chemicals Ltd.) | 6 parts |
| Tetrahydrofuran | 220 parts |
| Cyclohexanone | 80 parts |

Comparative Example 2

An electrophotographic photoconductor 18 was manufactured exactly as in Example 3, except that the protective layer-forming coating solution was replaced by the following composition.

| Protective layer coating solution | |
|---|---|
| Alumina (average first-order particle diameter: 0.3 μm, Sumitomo Chemical Co., Ltd.) | 2 parts |
| Compound expressed by Compound 1-1 | 0.5 parts |
| Polyester resin (acid value 7 mg KOH/g) | 0.2 parts |
| Charge transport material having the following structural formula | 4 parts |

-continued

| Protective layer coating solution | |
|---|---|
| 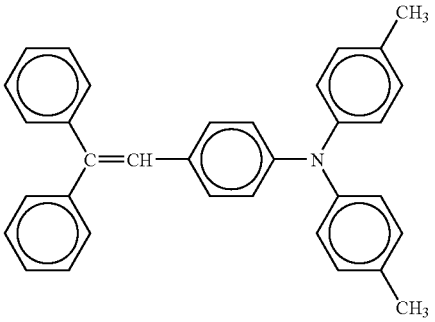 | |
| Polycarbonate (Z Polycarb, Teijin Chemicals Ltd.) | 6 parts |
| Tetrahydrofuran | 220 parts |
| Cyclohexanone | 80 parts |

Comparative Example 3

An electrophotographic photoconductor 19 was manufactured exactly as in Example 1, except that the protective layer-forming coating solution was replaced by the following composition.

| Protective layer coating solution | |
|---|---|
| Alumina (average first-order particle diameter: 0.3 μm, Sumitomo Chemical Co., Ltd.) | 2 parts |
| Unsaturated polycarboxylic acid polymer solution (acid value 180 mg KOH/g, BYK Chemie GmbH) | 0.02 parts |
| Charge transport material having the following structural formula | 4 parts |
| 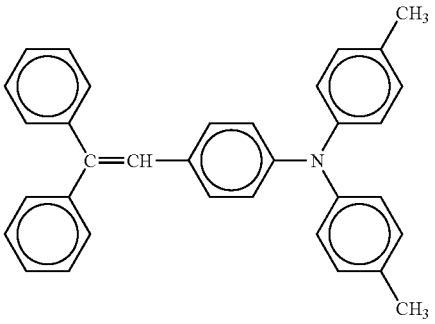 | |

-continued

| Protective layer coating solution | |
|---|---|
| Polycarbonate (Z Polycarb, Teijin Chemicals Ltd.) | 6 parts |
| Tetrahydrofuran | 220 parts |
| Cyclohexanone | 80 parts |

Example 17

An electrophotographic photoconductor 20 was manufactured exactly as in Example 1, except that the compound represented by the Compound 1-1 in the protective layer was replaced by the compounds 1 to 4.

Example 18

An electrophotographic photoconductor 21 was manufactured exactly as in Example 1, except that the compound represented by the Compound 1-1 in the protective layer was replaced by the compounds 1 to 8.

Example 19

An electrophotographic photoconductor 22 was manufactured exactly as in Example 1, except that the compound represented by the Compound 1-1 contained in the protective layer coating solution was replaced by the compounds 1 to 10.

Example 20

An electrophotographic photoconductor 23 was manufactured exactly as in Example 1, except that the compound represented by the Compound 1-1 contained in the protective layer coating solution was replaced by the compounds 2 to 2.

Example 21

An electrophotographic photoconductor 24 was manufactured exactly as in Example 20, except that the polycarboxylic acid contained in the protective layer was replaced by the material used in Example 2.

Example 22

An electrophotographic photoconductor 25 was manufactured exactly as in Example 20, except that the polycarboxylic acid contained in the protective layer was replaced by the material used in Example 3.

Example 23

An electrophotographic photoconductor 26 was manufactured exactly as in Example 20, except that the polycarboxylic acid contained in the protective layer was replaced by the material used in Example 4.

Example 24

An electrophotographic photoconductor 27 was manufactured exactly as in Example 20, except that the polycarboxylic acid contained in the protective layer was replaced by the material used in Example 5.

Example 25

An electrophotographic photoconductor 28 was manufactured exactly as in Example 20, except that the polycarboxylic acid contained in the protective layer was replaced by the material used in Example 6.

Example 26

An electrophotographic photoconductor 29 was manufactured exactly as in Example 20, except that the polycarboxylic acid contained in the protective layer was replaced by the material used in Example 7.

Example 27

An electrophotographic photoconductor 30 was manufactured exactly as in Example 20, except that the polycarboxylic acid contained in the protective layer was replaced by the material used in Example 8.

Example 28

An electrophotographic photoconductor 31 was manufactured exactly as in Example 20, except that the addition amount of polycarboxylic acid contained in the protective layer was replaced by that of Example 9.

Example 29

An electrophotographic photoconductor 32 was manufactured exactly as in Example 20, except that the addition amount of acid acrylic resin contained in the protective layer was replaced by that of Example 10.

Example 30

An electrophotographic photoconductor 33 was manufactured exactly as in Example 20, except that the filler contained in the protective layer was replaced by that of Example 11.

Example 31

An electrophotographic photoconductor 34 was manufactured exactly as in Example 20, except that the filler contained in the protective layer was replaced by that of Example 12.

Example 32

An electrophotographic photoconductor 35 was manufactured exactly as in Example 20, except that the filler contained in the protective layer was replaced by that of Example 13.

Example 33

An electrophotographic photoconductor 36 was manufactured exactly as in Example 20, except that the charge transport material and binder resin contained in the protective layer was replaced by that of Example 14.

Example 34

An electrophotographic photoconductor 37 was manufactured exactly as in Example 20, except that the binder resin contained in the protective layer was replaced by that of Example 15.

Example 35

An electrophotographic photoconductor 38 was manufactured exactly as in Example 20, except that the charge generating solution coating solution and charge transport layer coating solution were replaced by those of Example 16, and the protective layer coating solution was replaced by the following composition.

| Protective layer coating solution | |
|---|---|
| Alumina-treated titanium oxide (average first-order particle diameter 0.035 μm, Tayca Corporation) | 1.5 parts |
| Compound represented by the Compound 2-2 | 0.5 parts |
| Methacrylic acid/methyl methacrylate copolymer (acid value 50 mg KOH/g) | 0.5 parts |
| C type polycarbonate (Teijin Chemicals Ltd.) | 5.5 parts |
| Charge transport material having the following structural formula | 4 parts |
| Tetrahydrofuran | 250 parts |
| Cyclohexanone | 50 parts |

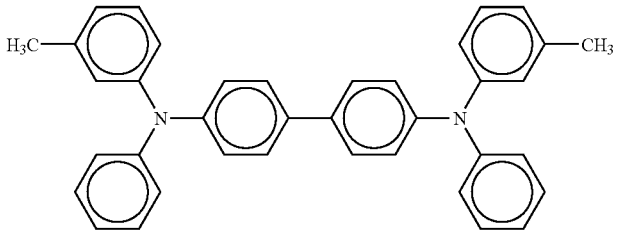

Comparative Example 4

An electrophotographic photoconductor 39 was manufactured exactly as in Example 20, except that the protective layer-forming coating solution was replaced by the following composition (the organic compound having an acid value of 10 mgKOH/g to 400 mgKOH/g was not added).

| Protective layer coating solution | |
|---|---|
| Alumina (average first-order particle diameter: 0.3 μm, Sumitomo Chemical Co., Ltd.) | 2 parts |
| Compound expressed by Compound 2-2 | 0.5 parts |
| Charge transport material having the following structural formula | 4 parts |
| Polycarbonate (Z Polycarb, Teijin Chemicals Ltd.) | 6 parts |
| Tetrahydrofuran | 220 parts |
| Cyclohexanone | 80 parts |

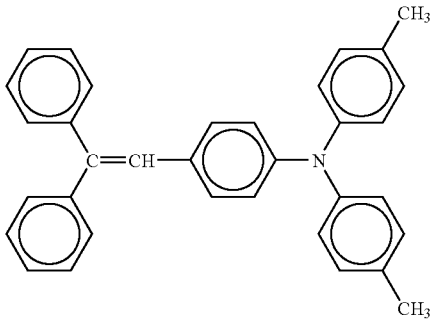

Comparative Example 5

An electrophotographic photoconductor 40 was manufactured exactly as in Example 22, except that the protective layer-forming coating solution was replaced by the following composition (the acid value of the added organic compound was less than 10 (mgKOH/g)).

| Protective layer coating solution | |
|---|---|
| Alumina (average first-order particle diameter: 0.3 μm, Sumitomo Chemical Co., Ltd.) | 2 parts |
| Compound expressed by Compound 2-2 | 0.5 parts |
| Polyester resin (acid value 7 mg KOH/g) | 0.2 parts |
| Charge transport material having the following structural formula | 4 parts |
| Polycarbonate (Z Polycarb, Teijin Chemicals Ltd.) | 6 parts |
| Tetrahydrofuran | 220 parts |
| Cyclohexanone | 80 parts |

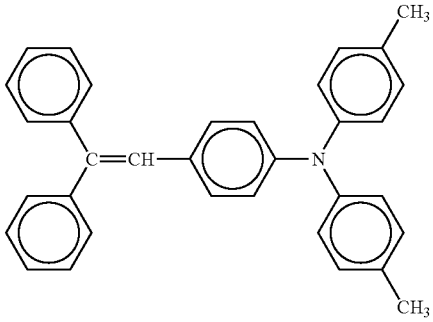

Example 36

An electrophotographic photoconductor 41 was manufactured exactly as in Example 20, except that the compound represented by the Compound 2-2 in the protective layer was replaced by the compounds 2 to 8.

The electrophotographic photoconductors 1–41 manufactured as described above were installed in an electrophotography process cartridge wherein the charging system was the corona charging system (scorotron), the part potential was set to 900 (−V) in a Ricoh imagio MF2200 modified unit using a 655 nm semiconductor laser as the image exposure light source, 50,000 sheets were continuously printed, and the initial image and the image after printing the 50,000 sheets were evaluated. The bright part potential after initial printing and after printing the 50,000 sheets was measured. Also, the abrasion loss was evaluated from the thickness difference after initial printing and after printing the 50,000 sheets.

TABLE 3

| | Initial | | After printing 50,000 sheets | | |
|---|---|---|---|---|---|
| Photo-conductor No. | Bright part potential (−V) | Image quality | Bright part potential (−V) | Image quality | Wear amount (μm) |
| 1 | 110 | Good | 135 | Good | 0.49 |
| 2 | 105 | Good | 135 | Good | 0.51 |
| 3 | 155 | Good | 205 | Good | 0.50 |
| 4 | 135 | Good | 200 | Good | 0.51 |
| 5 | 140 | Good | 185 | Good | 0.50 |
| 6 | 110 | Good | 155 | Good | 0.51 |
| 7 | 110 | Good | 150 | Good | 0.50 |
| 8 | 200 | Good | 285 | Medium degree of Image density decrease | 0.56 |
| 9 | 120 | Good | 150 | Good | 0.54 |
| 10 | 125 | Good | 175 | Good | 0.55 |
| 11 | 130 | Good | 170 | Good | 0.56 |
| 12 | 120 | Good | 155 | Good | 0.70 |
| 13 | 110 | Good | 150 | Good | 0.79 |
| 14 | 110 | Good | 155 | Good | 0.53 |
| 15 | 130 | Good | 170 | Good | 0.48 |
| 16 | 120 | Good | 165 | Good | 0.44 |
| 17 (Comp. Ex. 1) | 260 | Image density decrease small | 385 | Large degree of Image density decrease Undistinguishable image | 1.02 |
| 18 (Comp. Ex. 2) | 240 | Image density decrease small | 350 | Large degree of Image density decrease Undistinguishable image | 0.93 |
| 19 (Comp. Ex. 3) | 120 | Good | 150 | Large degree of Image density decrease | 0.50 |
| 20 | 115 | Good | 140 | Good | 0.50 |
| 22 | 110 | Good | 145 | Good | 0.50 |
| 23 | 115 | Good | 140 | Good | 0.49 |
| 24 | 110 | Good | 150 | Good | 0.50 |
| 25 | 160 | Good | 210 | Good | 0.49 |
| 26 | 140 | Good | 200 | Good | 0.52 |
| 27 | 145 | Good | 190 | Good | 0.51 |
| 28 | 120 | Good | 165 | Good | 0.52 |
| 29 | 115 | Good | 155 | Good | 0.50 |
| 30 | 200 | Good | 295 | Small degree of Image density decrease | 0.52 |
| 31 | 125 | Good | 160 | Good | 0.52 |
| 32 | 125 | Good | 180 | Good | 0.59 |
| 33 | 135 | Good | 180 | Good | 0.57 |
| 34 | 125 | Good | 165 | Good | 0.72 |
| 35 | 115 | Good | 160 | Good | 0.79 |
| 36 | 115 | Good | 160 | Good | 0.52 |
| 37 | 135 | Good | 170 | Good | 0.49 |
| 38 | 130 | Good | 170 | Good | 0.44 |
| 39 (Comp. Ex. 4) | 275 | Image density low | 405 | Large degree of Image density decrease Undistinguishable image | 1.03 |
| 40 (Comp. Ex. 5) | 245 | Image density low | 360 | Large degree of Image density decrease Undistinguishable image | 0.93 |
| 41 | 120 | Good | 145 | Good | 0.51 |

From the test results of Table 3, the bright part potential can be largely decreased by adding the organic compound having an acid value of 10 to 400 (mgKOH/g) to the outermost surface layer of the photoconductor. Further, even after printing 50,000 sheets, there was little increase of bright part potential, and it was found that, in a photoconductor to which the compounds represented by the general formulas 1 and 2 were added, high image quality could consistently be obtained. It was further found that the wear amount was also suppressed, and that wear resistance was largely improved. On the other hand, in a photoconductor to which the organic compound having an acid value of 10 to 400 (mgKOH/g) was not added or wherein the acid value was less than 10 (mgKOH/g), the bright part potential was extremely high from the start, which caused a decrease of image density and a loss of resolution, while after printing 50,000 sheets, it was impossible to distinguish the image due to considerable loss of gradation. In these photoconductors, the wear amount after printing also largely increased and wear resistance considerably declined.

The electrophotographic photoconductors 1, 19 through 23 and 41 were left for four days in a desiccator adjusted to a nitrogen oxide gas concentration of 50 ppm, and the image (resolution) was evaluated before and after.

TABLE 4

| Photoconductor No. | Initial image quality resolution (lines/mm) | Image quality after standing resolution (lines/mm) |
|---|---|---|
| 1 | 8.0 | 8.0 |
| 19 (Comp. EX. 3) | 8.0 | 2.8 |
| 20 | 8.0 | 8.0 |
| 21 | 8.0 | 8.0 |
| 22 | 8.0 | 8.0 |
| 23 | 8.0 | 8.0 |
| 41 | 8.0 | 8.0 |

From the test results of Table 4, it is seen that by including the compound represented by the general formulas 1 and 2 in the outermost surface of the photoconductor, the resistance to oxidizing gas substantially improves.

Example 37

An electrophotographic photoconductor protective layer-forming coating solution B having the following composition was manufactured.

| Protective layer coating solution | |
|---|---|
| Alumina (average first-order particle diameter: 0.3 μm, Sumitomo Chemical Co., Ltd.) | 2 parts |
| Compound expressed by Compound 1-1 | 0.5 parts |
| Unsaturated polycarboxylic acid polymer solution (acid value 180 mg KOH/g, BYK Chemie GmbH) | 0.02 parts |
| Charge transport material having the following structural formula | 3.5 parts |

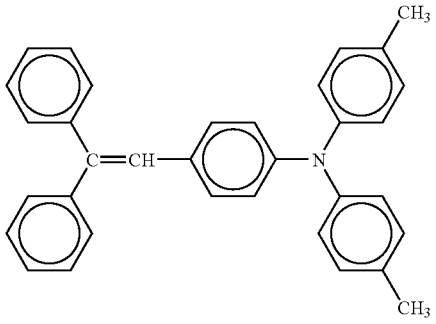

| | |
|---|---|
| Polycarbonate (Z Polycarb, Teijin Chemicals Ltd.) | 6 parts |
| Hydroquinone compound having the following structural formula: | 0.005 parts |

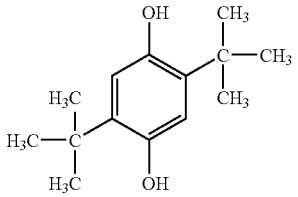

-continued

| Protective layer coating solution | |
|---|---|
| Tetrahydrofuran | 220 parts |
| Cyclohexanone | 80 parts |

Example 38

An electrophotographic photoconductor protective layer-forming coating solution C was manufactured exactly as in Example 37, except that the hydroquinone compound contained in the electrophotographic photoconductor protective layer-forming coating solution B was replaced by the hindered amine compound having the following structural formula.

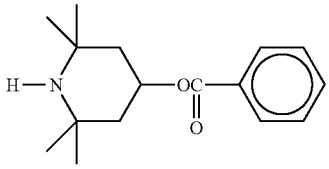

Example 39

An electrophotographic photoconductor protective layer-forming coating solution D was manufactured exactly as in Example 37, except that the hydroquinone compound contained in the electrophotographic photoconductor protective layer-forming coating solution B was replaced by the organic sulfur compound having the following structural formula.

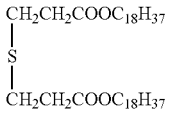

Example 40

An electrophotographic photoconductor protective layer-forming coating solution E was manufactured exactly as in Example 37, except that the hydroquinone compound contained in the electrophotographic photoconductor protective layer-forming coating solution B was replaced by the hindered phenol compound having the following structural formula.

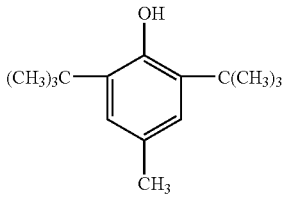

Example 41

An electrophotographic photoconductor protective layer-forming coating solution F was manufactured exactly as in Example 37, except that the hydroquinone compound contained in the electrophotographic photoconductor protective layer-forming coating solution B was replaced by the organic compound having the following structural formula.

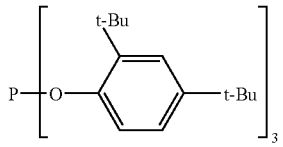

Examples 42–46

Electrophotographic photoconductor protective layer-forming coating solutions H–L were manufactured exactly as in Examples 37–41, except that the Compound 1-1 contained in the electrophotographic photoconductor protective layer-forming coating solutions B to F was replaced by the Compound 2-2.

The electrophotographic photoconductor protective layer-forming coating solution A of Example 1, the electrophotographic photoconductor protective layer-forming coating solution G of Example 20 and the electrophotographic photoconductor protective layer-forming coating solutions B–L of Examples 37–46 prepared as described above, were left to stand at room temperature in a dark place for 1 week, and the spectral extinction characteristic variation of the coating solution was examined.

TABLE 5

| | Optical absorbance variation rate at 665 nm |
|---|---|
| Coating solution A | 1.21 |
| Coating solution B | 1.01 |
| Coating solution C | 1.02 |
| Coating solution D | 1.10 |
| Coating solution E | 1.11 |
| Coating solution F | 1.12 |
| Coating solution G | 1.22 |
| Coating solution H | 1.02 |
| Coating solution I | 1.04 |
| Coating solution J | 1.11 |
| Coating solution K | 1.13 |
| Coating solution L | 1.15 |

(absorbancy variation rate)=(absorbancy of coating solution after storage)/(absorbancy immediately after coating solution preparation)Equation 1

From the results of Table 5, it is seen that due to the addition of an antioxidant, salt formation is suppressed and storage stability of the electrophotographic photoconductor to the layer-forming solution is considerably enhanced, and this improvement is particularly remarkable with hydroquinone compounds and hindered amine compounds.

As is clear from the aforesaid detailed description, according to the present invention, when a filler is added to the outermost surface layer of a photoconductor to improve endurance, the image blurring which tends to occur more easily due to this procedure is avoided by using a filler with highly insulating properties. Further, it was found that by adding an organic compound having an acid value of 10 to 400 (mgKOH/g), the marked residual potential rise which normally occurs, could be suppressed. The effect of adding the organic compound having an acid value of 10 to 400 (mgKOH/g) is not limited to suppression of residual potential, but also improves filler dispersibility and simultaneously suppresses sedimentation, so the film transparency improves, and an image without any image density unevenness and having a high resolution could be obtained. By simultaneously adding the compound represented by the general formulas 1 and 2, environmental resistance to oxidizing gases is largely improved, wear resistance is improved and film defects are suppressed. In addition, as the coating solution has a long lifetime, a high durability photoconductor which provides high resolution images is consistently obtained. According to the present invention, a high durability electrophotographic photoconductor is obtained together with high image quality, and it is therefore possible to provide an electrophotographic photoconductor which consistently offers high image quality over a long period of time.

What is claimed is:

1. An electrophotographic photoconductor, comprising:

a conductive support; and a photosensitive layer dispoded above the conductive support, wherein the electrophotographic photoconductor, in an outermost layer of the electrophotographic photoconductor, comprises:

a filler, an organic compound having an acid value of 10 mgKOH/g to 400 mgKOH/g, and at least one selected from the group consisting of compounds represented by the following general formulas 1 and 2:

General Formula 1

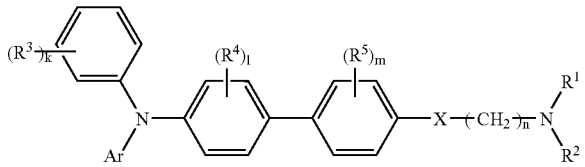

General Formula 2

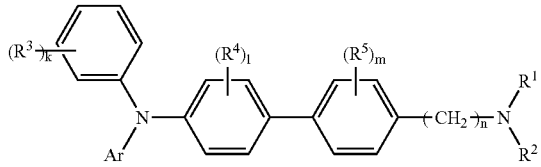

where $R^1$, $R^2$ are substituted or unsubstituted alkyl groups or aromatic hydrocarbon rings, and may be identical or different; $R^1$, $R^2$ may also be bonded together to form a substituted or unsubstituted heterocycle containing a nitrogen atom; $R^3$, $R^4$, $R^5$ are substituted or unsubstituted alkyl or alkoxy groups, or halegen atoms; Ar is a substituted or unsubstituted or unsubstituted aromatic hydrocarbon ring or aromatic heterocycle; n is an integer in the range 2 to 4; k, l, m are respectively integers in the range 0 to 3; and X is, in the general formula 1, an oxygen atom, or a sulfur atom.

2. An electrophotographic photoconductor according to claim 1, wherein the organic compound having an acid value of 10 mgKOH/g to 400 mgKOH/g, is a polycarboxylic acid.

3. An electrophotographic photoconductor according to claim 1, wherein the organic compound having an acid value of 10 mgKOH/g to 400 mgKOH/g, is at least one selected from the group consisting of a polyester resin, an acrylic resin and a copolymer comprising these structures.

4. An electrophotographic photoconductor according to claim 1, wherein at least one of organic fatty acids is mixed with the organic compound having an acid value of 10 mgKOH/g to 400 mgKOH/g.

5. An electrophotographic photoconductor according to claim 1, wherein the filler is at least one of inorganic materials.

6. An electrophotographic photoconductor according to claim 5, wherein the inorganic material is a metal oxide.

7. An electrophotographic photoconductor according to claim 5, wherein the pH of the inorganic material is 5 or more.

8. An electrophotographic photoconductor according to claim 5, wherein the dielectric constant of the inorganic material is 5 or more.

9. An electrophotographic photoconductor according to claim 1, wherein the average first-order particle diameter of the filler is 0.01 μm to 0.5 μm.

10. An electrophotographic photoconductor according to claim 1, wherein the outermost surface layer is a photosensitive layer.

11. An electrophotographic photoconductor according to claim 10, wherein the photosensitive layer comprises a charge generating layer containing a charge generating material an a charge transport layer containing a charge transport material, the outermost surface layer being the charge transport layer.

12. An electrophotographic photoconductor according to claim 11, wherein the charge transport material is a polymer charge transport material.

13. An electrophotographic photoconductor according to claim 1, wherein the electrophotographic photoconductor comprises a protective layer, the protective layer being the outermost surface layer.

14. An electrophotographic photoconductor according to claim 13, wherein the protective layer contains at least one of charge transport materials.

15. An electrophotographic photoconductor according to claim 14, wherein the charge transport material is a polymer charge transport material.

16. An electrophotographic photoconductor according to claim 1, wherein the outermost surface layer of the photoconductor contains as a binder resin at least one selected from the group consisting of a polycarbonate resin and a polyarylate resin.

17. An electrophotographic photoconductor according to claim 1, wherein the outermost surface layer is formed by coating an outermost surface layer coating solution containing:

a filler;

an organic compound having an acid value of 10 mgKOH/g to 400 mgKOH/g;

at least one selected from the group consisting of compounds represented by the above general formulas 1 and 2; and an antioxidant.

18. The electrophotographic photoconductor according to claim 17, wherein the antioxidant is one selected from the group consisting of a hydroquinone compound and a hindered amine compound.

19. An electrophotographic photoconductor outermost surface layer coating solution, comprising:

a filler;

an organic compound having an acid value of 10 mgKOH/g to 400 mgKOH/g;

at least one selected from the group consisting of compounds represented by the following general formulas 1 and 2:

General Formula 1

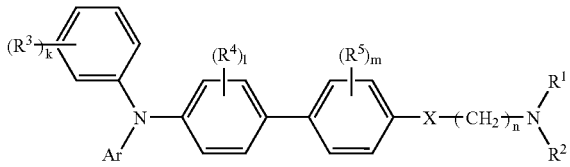

General Formula 2

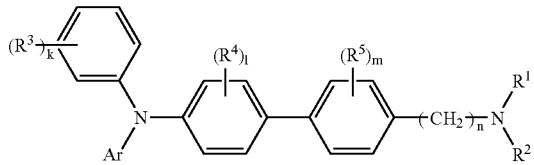

where $R^1$, $R^2$ are substituted or unsubstituted alkyl groups or aromatic hydrocarbon rings, and may be identical or different; $R^1$, $R^2$ may also be bonded together to form a substituted or unsubstituted heterocycle containing a nitrogen atom; $R^3$, $R^4$, $R^5$ are substituted or unsubstituted alkyl or alkoxy groups, or halogen atoms; Ar is a substituted or unsubstituted aromatic hydrocarbon ring or aromatic heterocycle; n is a integer in the range 2 to 4; k, l, m are respectively integers in the range 0 to 3; and X is, in the general formula 1, an oxygen atom, or a sulfur atom; and an antioxidant.

20. An electrophotographic photoconductor outermost surface layer coating solution according to claim 19, wherein the antioxidant in one selected from the group consisting of a hydroquinone compound and a hindered amine compound.

21. An electrophotographic method, comprising the steps of:

charging an electrophotographic photoconductor;

exposing the charged photoconductor with an imagewise light so as to form an latent electrostatic image thereon;

supplying a developer to the formed latent electrostatic image so that a toner image is formed, thereby visualizing the latent electrostatic image; and transferring the toner image formed by the developing step to a transfer material, wherein the toner graphic photoconductor, in an outermost surface layer of the electrophotographic photoconductor, comprises:

a filler, an organic compound having an acid value of 10 mgKOH/g to 400 mgKOH/g, and at least one selected from the group consisting of compounds represented by the following general formulas 1 and 2:

General Formula 1

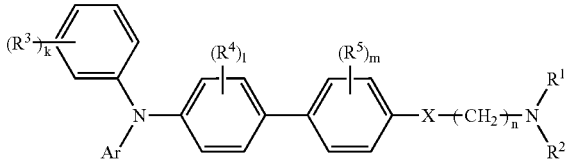

General Formula 2

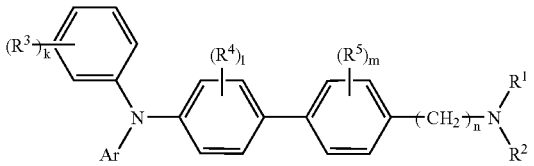

where $R^1$, $R^2$ are substituted or unsubstituted alkyl groups or aromatic hydrocarbon rings, and may be identical or different; $R^1$, $R^2$ may also be bonded together to form a substituted or unsubstituted heterocycle containing a nitrogen atom; $R^3$, $R^4$, $R^5$ are substituted or unsubstituted alkyl or alkoxy groups, or halogen atoms; Ar is a substituted or unsubstituted aromatic hydrocarbon ring or aromatic heterocycle; n is an integer in the range 2 to 4; k, l, m are respectively integers in the range 0 to 3; and X is, in the general formula 1, an oxygen atom, or a sulfur atom.

22. An electrophotographic method according to claim 21, wherein in the exposure step the latent electrostatic image is written on the electrophotographic photoconductor by a LD or LED.

23. An electrophotographic apparatus, comprising:

an electrophotographic photoconductor;

a charger configure to uniformly charge a surface of the electrophotographic photoconductor;

an exposure unit configured to expose the charged photoconductor by the charger with an imagewise light so as to form an latent electrostatic image on the photoconductor;

a developing unit configured to supply a developer to the latent electrostatic image so that a toner image is formed, thereby visualizing the latent electrostatic image; and a transfer unit configured to transfer the formed toner image by the developing unit to a transfer material, wherein the electrophotographic photoconductor, in an outermost surface layer of the electrophotographic photoconductor, comprises:

a filler, an organic compound having an acid value of 10 mgKOH/g to 400 mgKOH/g, and at least one selected from the group consisting of compounds represented by the following general formulas 1 and 2:

General Formula 1

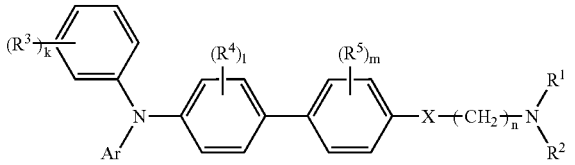

-continued

General Formula 2

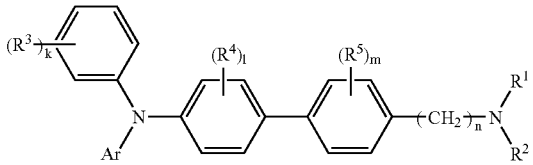

where, in the general formulas 1 and 2, $R^1$, $R^2$ are substituted or unsubstituted alkyl groups or aromatic hydrocarbon rings, and may be identical or different; $R^1$, $R^2$ may also be bonded together to form a substituted or unsubstituted heterocycle containing a nitrogen atom; $R^3$, $R^4$, $R^5$ are substituted or unsubstituted alkyl or alkoxy groups, or halogen atoms; Ar is a substituted or unsubstituted aromatic hydrocarbon ring or aromatic heterocycle; n is an integer in the range 2 to 4, and k, l, m are respectively integers in the range 0 to 3; and X is, in the general formula 1, an oxygen atom, or a sulfur atom.

24. An electrophotographic apparatus according to claim 23, wherein the exposure unit is configured so that the latent electrostatic image is written on the electrophotographic photoconductor by a LD or LED.

25. An electrophotographic process cartridge, comprising:

an electrophotographic photoconductor; and at least one selected from the group consisting of a charger configured to uniformly charge a surface of the electrophotographic photoconductor, a cleaning unit configured to clean the surface of the electrophotographic photoconductor, and a developing unit configured to supply a developer to a latent electrostatic image formed on the electrophotographic photoconductor so that a toner image is formed, thereby visualizing the latent electrostatic image, wherein the electrophotographic process cartridge is formed in a one-piece construction such that the electrophotographic process cartridge is freely replaceable from an electrophotographic apparatus, and wherein the electrophotographic photoconductor, in an outermost surface layer of the electrophotographic photoconductor, contains:

a filler, an organic compound having an acid value of 10 mgKOH/g to 400 mgKOH/g, and at least one selected from the group consisting of compounds represented by the following formulas 1 and 2:

General Formula 1

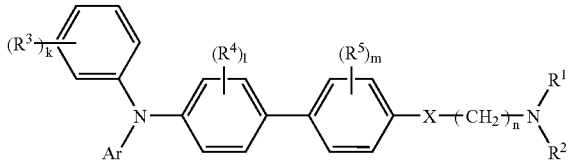

-continued

General Formula 2

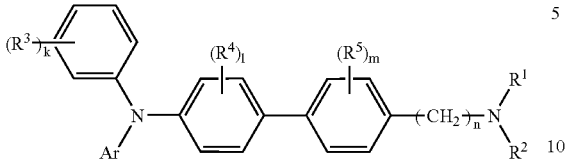

where $R^1$, $R^2$ are substituted or unsubstituted alkyl groups or aromatic hydrocarbon rings, and may be identical or different; $R^1$, $R^2$ may also be bonded together to form a substituted or unsubstituted heterocycle containing a nitrogen atom; $R^3$, $R^4$, $R^5$ are substituted or unsubstituted alkyl or alkoxy groups, or halogen atoms; Ar is a substituted or unsubstituted aromatic hydrocarbond ring or aromatic heterocycle; n is an integer in the range 2 to 4; k, l, m are respectively integers in the range 0 to 3; and X is, in the general formula 1, an oxygen atom, or a sulfur atom.

* * * * *

UNITED STATES PATENT AND TRADEMARK OFFICE

CERTIFICATE OF CORRECTION

PATENT NO. : 7,018,755 B2
DATED : March 28, 2006
INVENTOR(S) : Ikegami et al.

It is certified that error appears in the above-identified patent and that said Letters Patent is hereby corrected as shown below:

Title page, Item [54] and Column 1, line 1,
Title, should read -- ELECTROPHOTOGRAPHIC PHOTOCONDUCTOR, ELECTROPHOTOGRAPHY METHOD USING THE SAME, ELECTROPHOTOGRAPHIC APPARATUS, ELECTROPHOTOGRAPHIC APPARATUS PROCESS CARTRIDGE AND ELECTROPHOTOGRAPHIC PHOTOCONDUCTOR OUTERMOST SURFACE LAYER COATING SOLUTION --.

Signed and Sealed this

Sixth Day of June, 2006

JON W. DUDAS
*Director of the United States Patent and Trademark Office*